US006217391B1

(12) United States Patent
Colantuono et al.

(10) Patent No.: US 6,217,391 B1
(45) Date of Patent: Apr. 17, 2001

(54) LOW PROFILE MODULAR ELECTRICAL JACK AND COMMUNICATION CARD INCLUDING THE SAME

(75) Inventors: Robert Colantuono, Dover; Ronald Locati, York, both of PA (US)

(73) Assignee: Stewart Connector Systems, Inc., Glen Rock, PA (US)

( * ) Notice: Subject to any disclaimer, the term of this patent is extended or adjusted under 35 U.S.C. 154(b) by 0 days.

(21) Appl. No.: 09/276,209

(22) Filed: Mar. 25, 1999

Related U.S. Application Data

(60) Provisional application No. 60/079,447, filed on Mar. 26, 1998.

(51) Int. Cl.[7] ..... H01R 24/00
(52) U.S. Cl. ..... 439/676
(58) Field of Search ..... 439/676, 131, 439/946, 660, 626

(56) References Cited

U.S. PATENT DOCUMENTS

| | | | | |
|---|---|---|---|---|
| 4,674,822 | | 6/1987 | Hall | 439/399 |
| 4,717,217 | | 1/1988 | Bogese, II | 439/83 |
| 5,132,877 | | 7/1992 | Branan et al. | 361/395 |
| 5,183,404 | | 2/1993 | Aldous et al. | 439/55 |
| 5,336,099 | | 8/1994 | Aldous et al. | 439/131 |
| 5,338,210 | | 8/1994 | Beckham et al. | 439/131 |
| 5,364,294 | * | 11/1994 | Hatch et al. | 439/676 |
| 5,411,405 | | 5/1995 | McDaniels et al. | 439/131 |
| 5,457,601 | | 10/1995 | Georgopulos et al. | 361/686 |
| 5,478,261 | * | 12/1995 | Bogese, II | 439/676 |
| 5,547,401 | | 8/1996 | Aldous et al. | 439/676 |
| 5,667,395 | | 9/1997 | Okada et al. | 439/131 |
| 5,674,080 | | 10/1997 | Takemura | 439/159 |
| 5,674,093 | | 10/1997 | Vaden | 439/676 |
| 5,691,882 | | 11/1997 | Ma | 361/684 |
| 5,692,914 | | 12/1997 | Mitani et al. | 439/131 |
| 5,702,271 | | 12/1997 | Steinman | 439/676 |
| 5,704,802 | * | 1/1998 | Loudermilk | 439/490 |
| 5,736,910 | | 4/1998 | Townsend et al. | 333/181 |
| 5,773,332 | | 6/1998 | Glad | 439/344 |
| 5,775,946 | | 7/1998 | Briones | 439/607 |
| 5,879,199 | | 3/1999 | Belopolsky | 439/701 |
| 5,885,100 | | 3/1999 | Talend et al. | 439/490 |
| 5,957,730 | | 9/1999 | Wang | 439/676 |
| 5,971,813 | | 10/1999 | Kunz et al. | 439/676 |
| 5,975,960 | * | 11/1999 | Fogg et al. | 439/676 |
| 5,984,731 | * | 11/1999 | Laity | 439/676 |

FOREIGN PATENT DOCUMENTS

| | | | |
|---|---|---|---|
| 2101354 | 1/1994 | (CA) | H01R/13/639 |

* cited by examiner

*Primary Examiner*—Neil Abrams
*Assistant Examiner*—Michael C. Zarroli
(74) *Attorney, Agent, or Firm*—Steinberg & Raskin, P.C.

(57) ABSTRACT

Modular electrical jack including an outer housing part and an inner housing assembly connected to the outer housing part and defining one or more plug-receiving receptacles therewith. The inner housing assembly includes contact/terminal members, at least one of which includes a terminal portion adapted to be connected to a substrate, an arcuate contact portion extending into a respective plug-receiving receptacle and an intermediate bridging portion connecting the terminal portion and the contact portion. The bridging portion is inclined in relation to an inner surface of the outer housing part such that only a very short region of the bridging portion bears against the inner surface of the outer housing part and thus, remaining portions of the bridging portion are spaced from the inner surface. The construction of such contact/terminal members enables the jack to have a height less than that of contact/terminal members in existing jacks of the RJ type while providing the contact/terminal members with sufficient normal contact force to comply with FCC requirements. A communications card such as a PCMCIA card including the jack is also disclosed.

43 Claims, 26 Drawing Sheets

LOW PROFILE MODULAR ELECTRICAL JACK AND COMMUNICATION CARD INCLUDING THE SAME

CROSS-REFERENCE TO RELATED APPLICATION

This application claims priority of U.S. provisional patent application Ser. No. 60/079,447 filed Mar. 26, 1998.

FIELD OF THE INVENTION

The present invention relates generally to electrical connectors and, more particularly, to modular electrical jacks having a lower profile than conventional modular electrical jacks, e.g., modular jacks of the type disclosed in U.S. Pat. No. 4,703,991.

The present invention also relates to communication cards for personal computers, such as PCMCIA (personal computer memory card international association) cards, which include an electrical jack to enable the computer to receive and transmit data through the same.

BACKGROUND OF THE INVENTION

The use of modular connectors, i.e., plugs and jacks, in data communications applications, such as communication cards, has become common. Since the structure and dimensions of modular connectors have become standardized and since the mating and disengagement of modular plugs and modular jacks are simple and familiar to most individuals, the use of modular connectors is especially suited to data communication applications where interchangeability or detachability of components is desirable.

In view of the ever-decreasing size of computer equipment, and in particular the thickness of a slot in a laptop computer receivable of a PCMCIA Type III communication card (about 10.5 mm), a need has arisen to provide a modular jack of the RJ type with a maximum height of about 10.5 mm, which is less than the height of conventional modular jacks of the RJ type (about 11.5 mm), while meeting or exceeding FCC requirements. A significant problem with reducing the size of modular jacks of the RJ-type to this height has been the inability to fit a contact/terminal member (an electrical contact having a contact portion extending into the plug-receiving receptacle of the jack and a terminal portion adapted to be connected to a substrate on which the jack is mounted, such as a printed circuit board) in a jack housing having this size and achieve normal contact forces while complying with FCC requirements.

Nevertheless, in the prior art, this problem has been circumvented to a certain extent by modifying the construction of the communication card or providing an attachment for the communication card in order to enable the communications card to define a receptacle receivable of an RJ-type plug. Indeed, in the prior art, there are at least five different constructions of electrical connectors for communication cards which mate with RJ-type electrical connectors.

A first type of prior art connector is designed as a retractable or extendible jack connector having a recess receivable of an RJ-xx series plug and which extends outward from the communication card to a position outside of the card slot of the computer when the card is installed therein (see, for example, U.S. Pat. No. 5,338,210). These connectors slidably extend from the card and define the recess receivable of the RJ-xx series plug which is oriented such that the direction which the plug travels when being inserted into the recess is parallel or perpendicular to the upper and lower surfaces of the card or at an angle thereto.

A second type of prior art connector is an arrangement having a specialized female and male component designed with a height which is smaller than the height of the communication card, e.g., 10.5 mm for the PCMCIA Type III card. For example, as shown in U.S. Pat. No. 5,457,601, the card has a specialized two pin connector, the female portion of which is unitary with the card and the male portion of which is connected to one end of a cable. The other end of the cable has an RJ-type plug for connection to a telephone line. One obvious drawback of such an arrangement is the connector on the card itself is not receivable of standard RJ-xx series plugs.

A third type of prior art connector is an arrangement in which the communication card has a unitary jack connector which defines a recess receivable of an RJ-xx series plug. The recess opens onto one of the major surfaces of the card and is oriented such that the direction which the plug travels when being inserted into the recess is at an angle to the upper surface of the card. For example, U.S. Pat. No. 5,338,210 describes a card having a recess opening onto the upper surface of the card and oriented at an angle to the upper surface (FIG. 14). The housing of the computer includes an access tunnel above the card slot to enable the plug to be inserted into the recess. The use of such a connector requires modification of the computer housing.

A fourth type of prior art connector is an arrangement in which the communication card has a unitary jack connector in a jack portion of the card which is situated outside of the card slot, i.e., exterior of the computer housing, during use. For example, U.S. Pat. No. 5,547,401 describes a communication card having an integrated connector having an RJ-11 receptacle (FIGS. 8 and 9). The integrated connector has a thickness greater than the thickness of the card.

Additional types of prior art connectors are shown in U.S. Pat. No. 5,773,332 (Glad) which describes several approaches to constructing a specific communication card including an RJ type jack receivable of an RJ-xx series plug, i.e., a PCMCIA Type III card having a thickness less than 10.5 mm. For example, as shown in FIGS. 1–20, the PCMCIA Type III card is constructed to receive the RJ-xx series plug in a direction substantially perpendicular to the upper and lower surfaces of the card either in a receptacle module separable from the card (e.g., FIGS. 1–3, 12, 13) or in a receptacle module which is housed within the card and extendible therefrom when in use (e.g., FIGS. 4–11)). On the other hand, FIG. 21 shows a PCMCIA Type III card having a unitary jack connector defining a recess structured to receive a mating RJ-xx series plug in a direction substantially parallel to upper and lower surfaces of the card. The particular construction of the contact/terminal members in the jack are not disclosed.

OBJECTS AND SUMMARY OF THE INVENTION

Accordingly, it is an object of the present invention to provide new and improved single-port and multi-port modular connectors of the RJ-type.

It is yet another object of the present invention to provide new and improved low-profile modular jacks, i.e., jacks having a height less than the height of conventional modular jacks of the RJ-type which is about 11.5 mm.

Still another object of the present invention is to provide new and improved modular jacks for use in communication cards, such as a PCMCIA card.

Yet another object of the present invention is provide new and improved communication cards including a jack receivable of at least one RJ-type plug.

Another object of the present invention is to provide new and improved communication cards including a jack receivable of at least one RJ-type plug whereby the jack is oriented in the card so that the jack receives the plug(s) in a direction substantially parallel to the major surfaces of the card.

It is another object of the present invention is to provide new and improved communication cards including a jack receivable of at least one RJ-type plug whereby the jack is oriented in the card so that the card could extend minimally outside of a standard-sized communication card slot of a personal computer yet still enable releasable coupling of the plug(s) to the jack.

Briefly, in accordance with the present invention, these and other objects are obtained by providing a modular jack comprising a multiple-piece design including an outer housing part and an inner housing assembly connected to the outer housing part and defining at least one plug-receiving receptacle therewith. The inner housing assembly includes contact/terminal members, each including a terminal portion adapted to be mounted to a printed circuit board, a contact portion extending in the receptacle and adapted to engage a contact of a mating plug upon insertion thereof into the receptacle and an intermediate bridging portion connecting the terminal portion and the contact portion. The contact portion is arcuate, e.g., concave or convex, and the bridging portion is inclined in relation to an inner surface of the outer housing part such that only a very short region of the bridging portion bears against an inner surface of the outer housing part, i.e., a point contact, and thus, remaining portions of the bridging portion are spaced from the inner surface. In this manner, the contact/terminal member is able to be formed with a height to enable a jack including such contact/terminal members to have a height less than that of existing jacks of the RJ-type including conventional contact/terminal members while still providing sufficient normal contact force to comply with FCC requirements.

More particularly, the inner housing assembly comprises an inner housing part and discrete contact/terminal-retainer assembly whereby at least one of the contact/terminal member is arranged in each contact/terminal-retainer assembly. Each contact/terminal-retainer assembly includes a retainer housing and the bridging portions of the contact/terminal members include an elongate section extending obliquely upward and outward from the retainer housing terminating in a curved section whereby a portion of the curved section bearing against an inner surface of the outer housing part. To this end, the outer housing part includes a top wall having an inner surface including recessed grooves whereby the short region of the bridging portion (i.e., a portion about the curved section) of each contact/terminal member is arranged in a respective groove.

Another embodiment of a modular electrical jack in accordance with the invention comprises an outer housing part and an inner housing assembly arranged in an interior of the outer housing part and defining at least one plug-receiving receptacle with the outer housing part. The inner housing assembly comprises an inner housing part, and at least one contact/terminal-retainer assembly mounted in connection therewith and in alignment with a respective plug-receiving receptacle. Each contact/terminal-retainer assembly includes a retainer housing and a plurality of elongate contact/terminal members formed of conductive material. At least one contact/terminal member includes a contact portion extending into the respective plug-receiving receptacle, a terminal portion mounted partially in the inner housing part, and an intermediate bridging portion connecting the terminal portion and the contact portion and arranged at least partially in the retainer housing. Preferably, the contact portion is arcuate and a portion of the bridging portion is inclined in relation to an inner surface of the outer housing part such that only a very short region of the inclined bridging portion bears against an inner surface of the outer housing part and thus, remaining portions of the bridging portion are spaced from the inner surface.

Another embodiment of a modular electrical jack in accordance with the invention is a multi-port jack and comprises an outer housing part and an inner housing assembly arranged in an interior of the outer housing part and defining plug-receiving receptacles with the outer housing part. The inner housing assembly includes an inner housing part and discrete contact/terminal-retainer assemblies mounted in connection with the inner housing part and in alignment with a respective plug-receiving receptacle. Each contact/terminal-retainer assembly includes a plurality of elongate contact/terminal members formed of conductive material, each contact/terminal member including a contact portion extending through the respective plug-receiving receptacle, a terminal portion mounted in the inner housing part, and an intermediate bridging portion connecting the terminal portion and the contact portion. The contact portion is preferably arcuate and the bridging portion is preferably inclined in relation to an inner surface of the outer housing part such that a very short region of the bridging portion bears against an inner surface of the outer housing part and remaining portions of the bridging portion are spaced from the inner surface. In this regard, each contact/terminal-retainer assembly includes a housing and the bridging portion includes an elongate section extending obliquely upward and outward from the housing to a level above the top wall of the housing and terminates in the curved section. The jack also preferably includes cooperating securing means arranged on the inner housing part and the contact/terminal-retainer assemblies for securing the retainer housing of each contact/terminal-retainer assembly to the inner housing part.

The communication card for use in a data utilization device in accordance with the invention includes a card member having a first and second end, a printed circuit board having electronic communications components mounted thereon and being situated between the printed circuit board and the card member, an electrical connector arranged at the first end of the card member for enabling electrical connection to the data utilization device, and a jack connected to the second end of the card member and receivable of a mating plug. In accordance with the invention, the jack comprises an outer housing part and an inner housing assembly connected to the outer housing part and defining at least one plug-receiving receptacle with the outer housing part. The inner housing assembly includes contact/terminal members, each including a terminal portion electrically coupled to the printed circuit board, an arcuate contact portion situated in the plug-receiving receptacle and an intermediate bridging portion connecting the terminal portion to the contact portion. The bridging portion is inclined in relation to an inner surface of the outer housing part such that a very short region of the bridging portion bears against an inner surface of the outer housing part and remaining portions of the bridging portion are spaced from the inner surface. More particularly, the inner housing assembly comprises an inner housing part and at least one discrete contact/terminal-retainer assembly, the contact/terminal members are arranged in each contact/terminal-retainer assembly. Each contact/terminal-retainer assembly includes a housing and the bridging portion including an elongate section extending obliquely upward and outward from the housing to a level above a top wall of the housing and terminates in a curved section.

BRIEF DESCRIPTION OF THE DRAWINGS

A more complete appreciation of the present invention and many of the attendant advantages thereof will be readily understood by reference to the following detailed description when considered in connection with the accompanying drawings in which.

DETAILED DESCRIPTION OF THE PREFERRED EMBODIMENTS

A low profile modular electrical jack in accordance with the invention will be described with reference to a communication card including the same. A communication card is a type of electronic component designed for insertion into a slot in a computer which enables the computer to transmit and receive data through a cable connected to the card. In view of the size of slots in certain computers, e.g., laptop computers, and in accordance with industry standards, the card must be quite thin and therefore the jack in accordance with the invention is particularly suited for use in such a card. However, the jack may be used alone as a stand alone jack, e.g., mountable directly to a printed circuit board of a computer (the motherboard), or in numerous other applications, i.e., essentially all those applications requiring an RJ-type receptacle for receiving a mating RJ-type plug. A primary difference between the use of the jack for different applications would be the construction of the housing of the jack. The construction of the contact/terminal members in the jack in accordance with the invention as shown in the illustrated embodiment, which is a novel design which enables the jack to have a lower profile in comparison with existing RJ-type jacks (such as those disclosed in U.S. Pat. No. 4,703,991), would be common to the jacks used for different applications. However, also included within the scope of the invention are jacks including the housing components described below (outer housing part, inner housing part and contact/terminal-retainer assembly housing) and other contact/terminal members which might not have a height resulting in a jack including the same to have a height lower than a conventional RJ-type jack. That is, the use of the outer housing part, inner housing part and contact/terminal-retainer assembly housing is not limited to low profile jacks including contact/terminal members such as described herein, or low profile jacks including other constructions of contact/terminal members, and each of these components can be used, either individually or in combination with one or both of the others, in other modular jacks.

Figure 1:
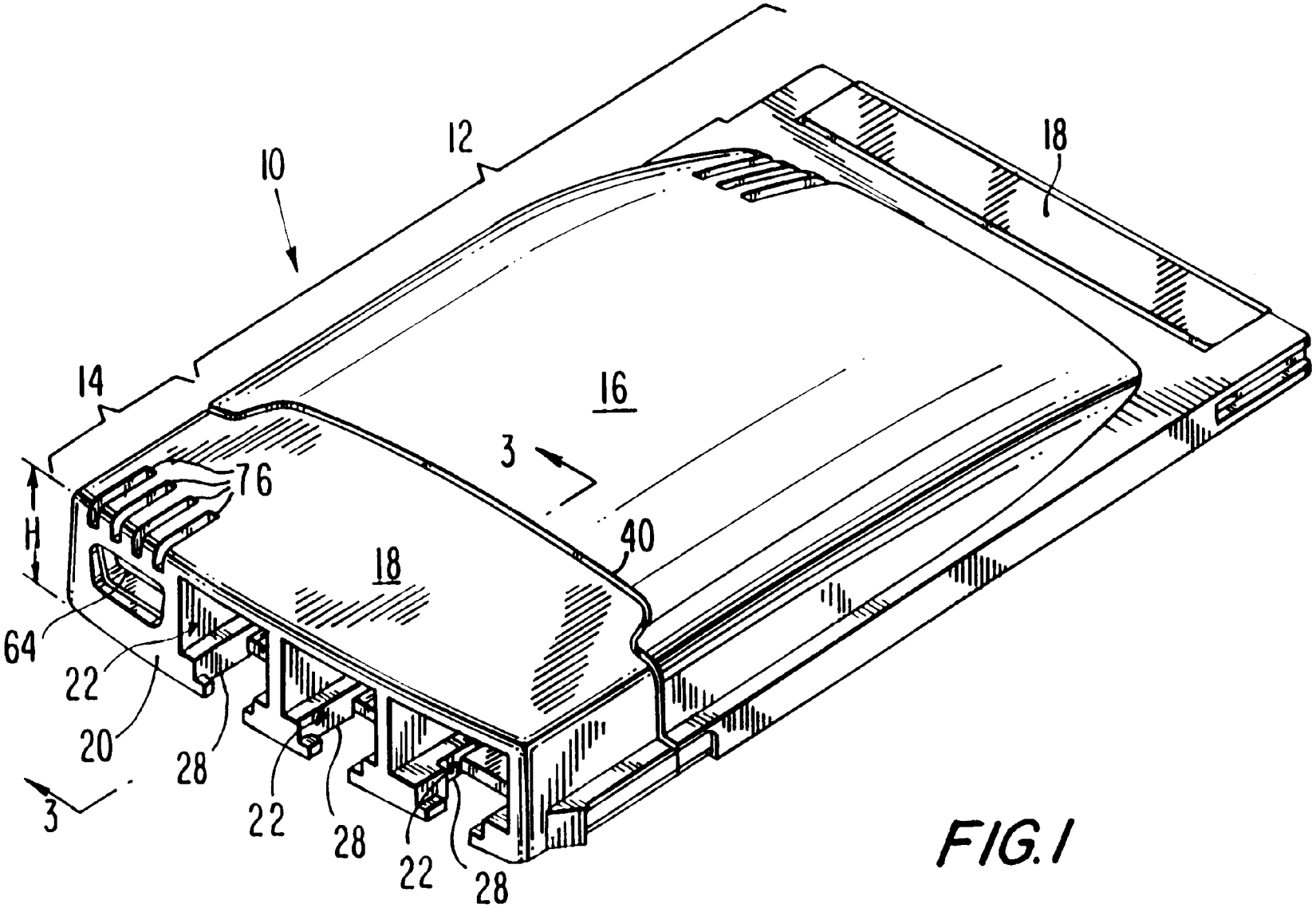
FIG. 1 is a perspective view of a communication card in accordance with the invention.

Referring now to the drawings wherein like reference characters designate identical or corresponding parts throughout the several views, a communication card in accordance with the invention is designated generally as 10 and includes a card member 12 and a modular, multi-port jack or jack adapter of the RJ-type 14 connected thereto (FIG. 1). The card member 12 has a top surface 16. The rear end of the card member 12 includes connector pads 18 of a known type for electrical connection of the card 10 to a personal computer. The particular shape of the card member 12 is not critical to the practice of the invention.

Figure 2:
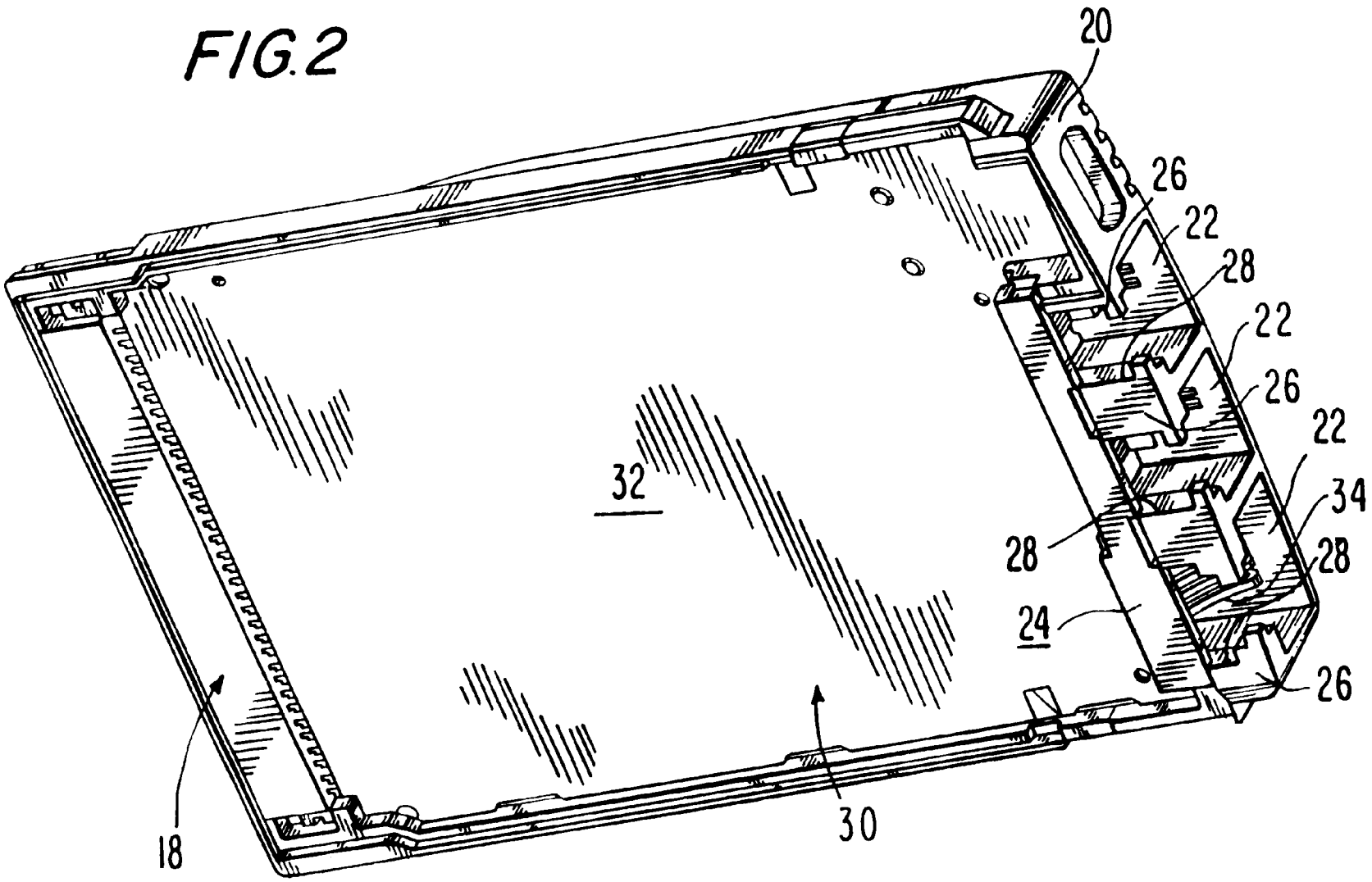
FIG. 2 is a bottom view of the communication card shown in FIG. 1.

The jack 14 includes a flat upper surface 18, which is contiguous and coplanar with the front portion of the top surface 16 of card member 12, a front face 20 defining a plurality of apertures or recesses 22 receivable of RJ-type plugs, and lower surfaces 24 and 26, in the latter of which cutouts 28 are formed for receiving the clip or latch of the RJ-type plugs (FIG. 2). The front face 20 of the jack 14 also defines an optional aperture 64 through which a computer cable may pass. A set of ventilation slots 76 is also formed in the jack 14 above the computer cable-receiving aperture 64, and is also an optional feature.

A printed circuit board 30 is arranged in the card 10 and the necessary electrical components for use of the card 10 are mounted, such as a data access arrangement of a type known in the art, are mounted on printed circuit board 30. The lower surface 32 of the printed circuit board 30 constitutes the lower surface of the card member 12, although a bottom cover may be provided to enclose the printed circuit board 30.

Figure 3:
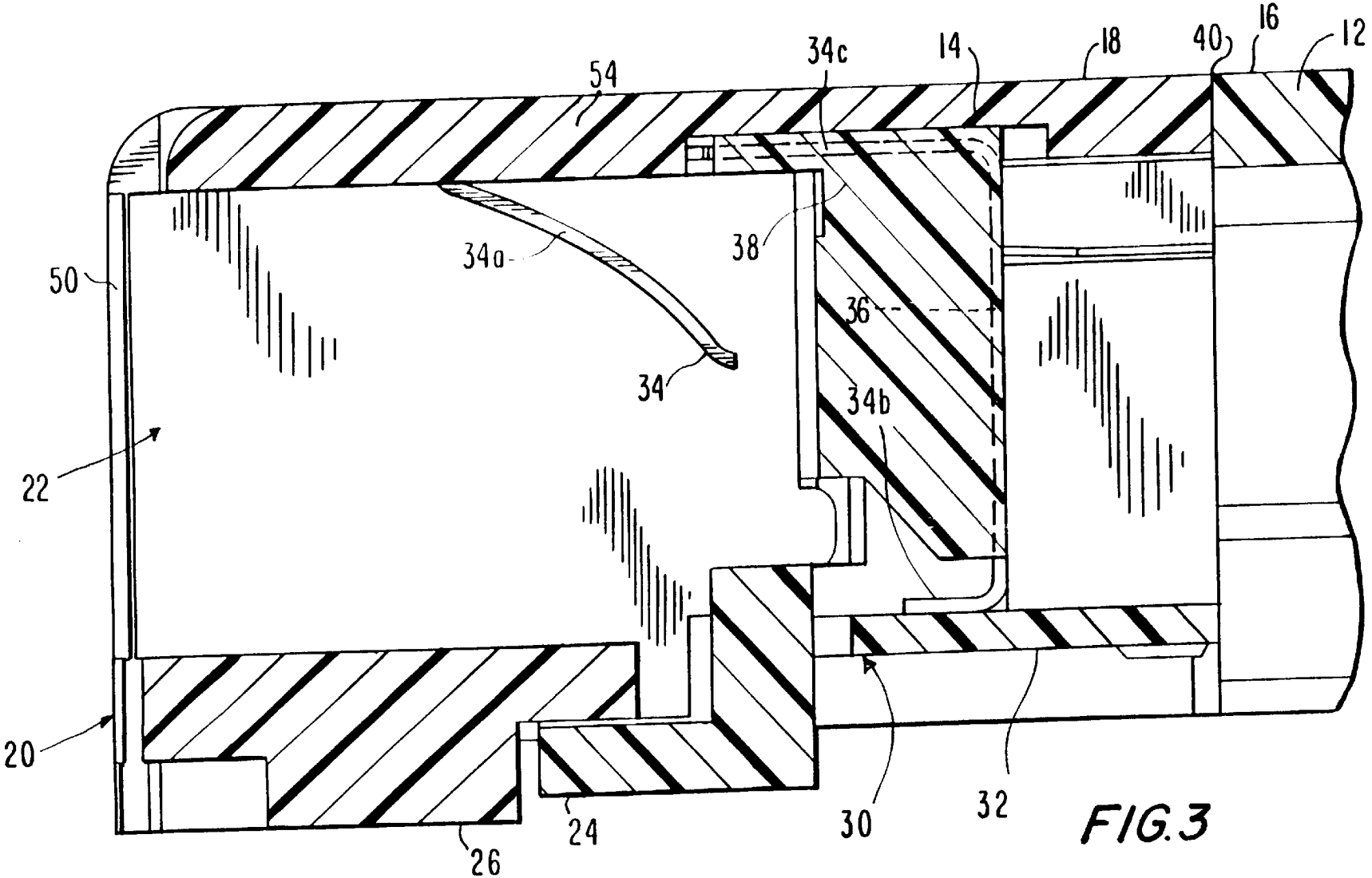
FIG. 3 is a cross-sectional view of the communication card of FIG. 1 taken along the line 3—3 of FIG. 1.

The jack 14 also includes contact/terminal members 34 made of electrically conductive material and which are connected to the printed circuit board 30, and an inner housing part or insert 36 which receives contact/terminal-retainer assemblies 38, each of which retains several contact/terminal members 34 (FIG. 3). Each contact/terminal member 34 includes a concave contact portion 34*a* situated in the respective plug-receiving receptacle 22, a terminal portion 34*b* mounted to a surface of the printed circuit board 30 (a surface-mounting arrangement) and an intermediate bridging portion 34*c* extending between the contact portion 34*a* and the terminal portion 34*b*. The card 10 is assembled by coupling the card member 12 to the jack 14 by connecting means (not shown) along contiguous mating surfaces 40.

As explained in greater detail below, the contact/terminal members 34 of the jack 14 have been specially designed to enable the height H of the jack 14 and thus the card 10 to be less than 10.5 mm while still providing the required spring-back force for the contact/terminal members 34 required by applicable FCC requirements for RJ-type connectors (0.96 N (100 grams)).

Although as shown, the card 10 is formed by a separate card member 12 and jack 14, in the alternative, it is possible to form the card 10 with an integral jack. Also, although the card 10 as shown includes three apertures 22 for receiving RJ-type plugs and a single cable-receiving aperture 64, the card 10 may include only a single aperture for receiving an RJ-type plug, or any other number of plug-receiving apertures and/or cable-receiving apertures, and such embodiments are within the scope and spirit of the invention.

Figure 4:
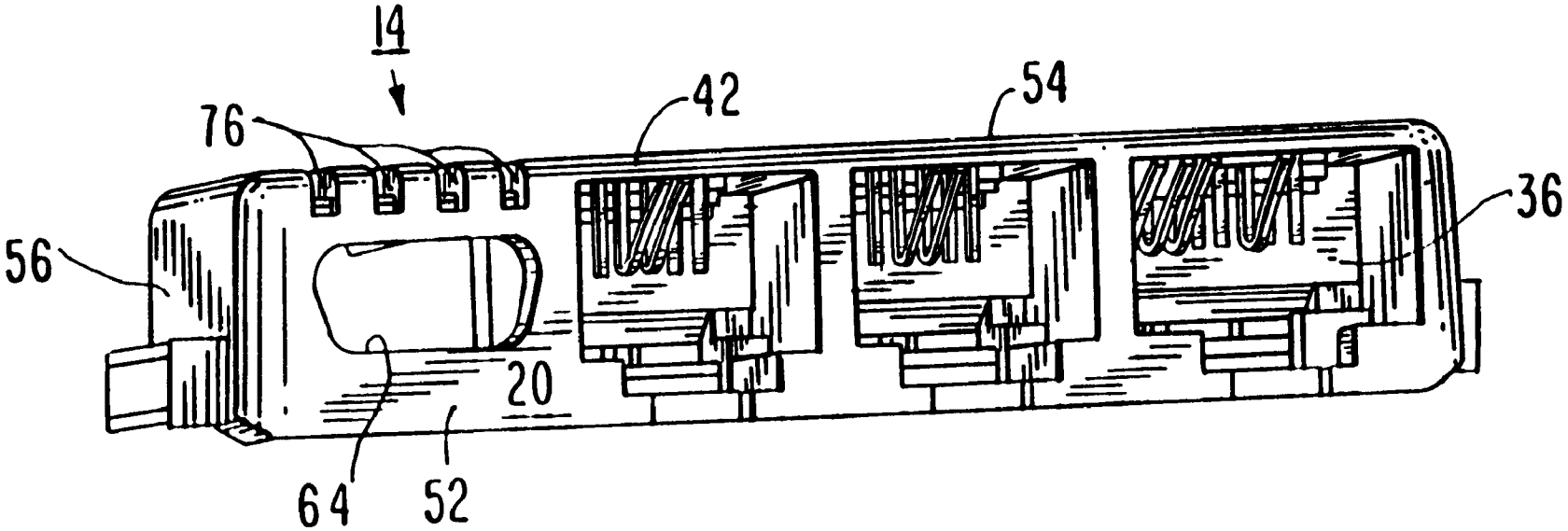
FIG. 4 is a perspective view of the modular jack in accordance with the invention for use in the communication card of FIG. 1.

Referring now to FIGS. 4–23, the jack 14 in accordance with a first embodiment of the present invention will be described in greater detail. As shown in FIG. 4, jack 14 includes an outer housing part 42 and an inner housing assembly 44 connected to the outer housing part 42 and defining the plug-receiving receptacles 22 therewith. The inner housing assembly 44 is formed by the inner housing part 36 and the contact/terminal-retainer assemblies 38 mounted in connection therewith.

Figure 5:
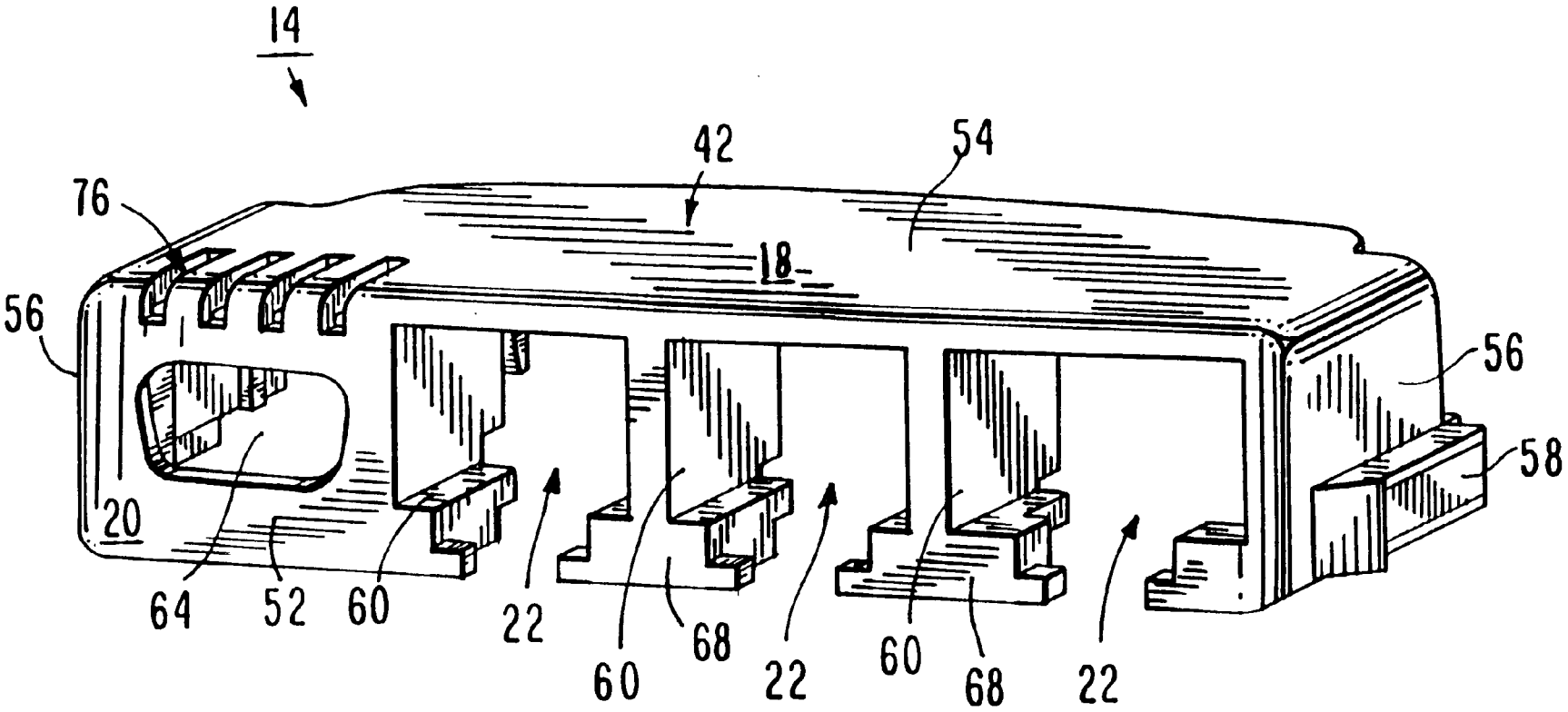
FIG. 5 is a perspective view of an outer housing part of the modular jack shown in FIG. 4.
Figure 5A:
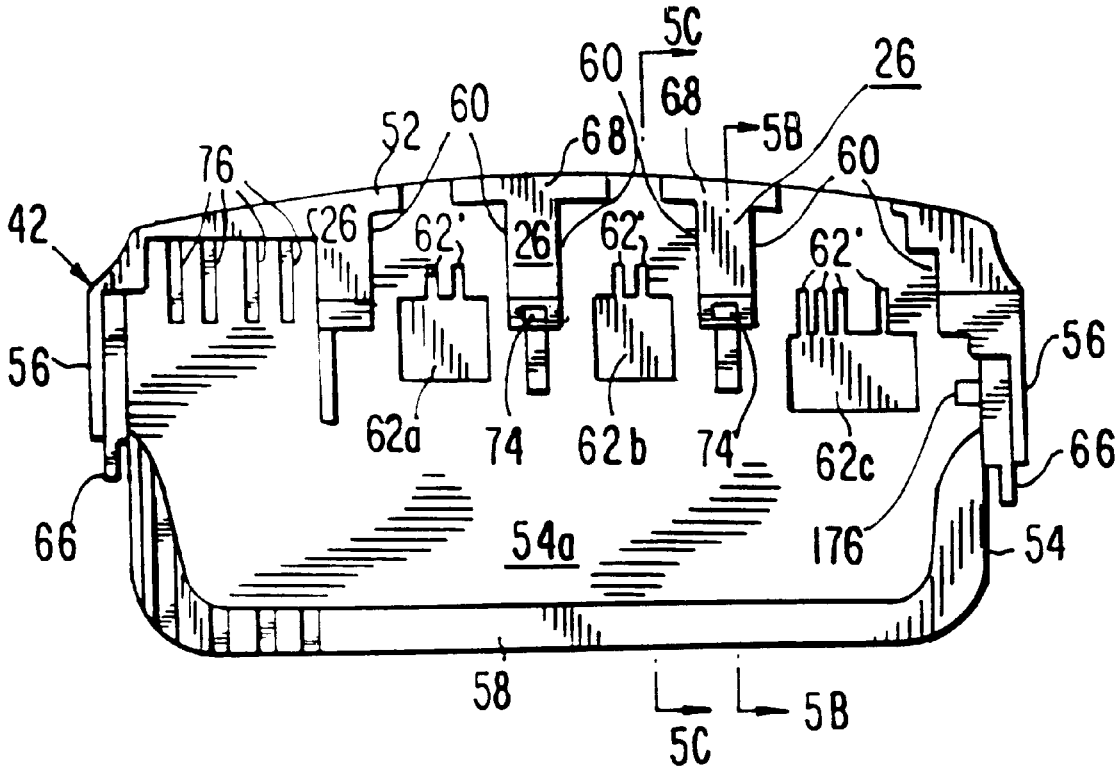
FIG. 5A is a bottom view of the outer housing part shown in FIG. 5.
Figure 5B:
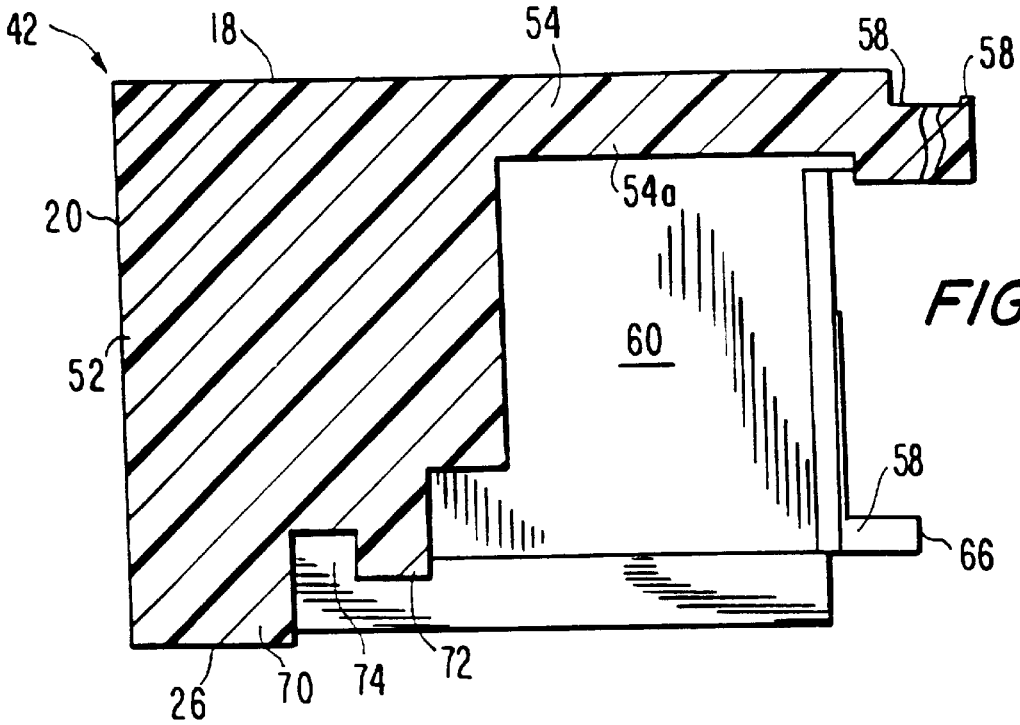
FIG. 5B is a cross-sectional view of the outer housing part shown in FIGS. 5 and 5A taken along the line 5B—5B of FIG. 5.
Figure 5C:
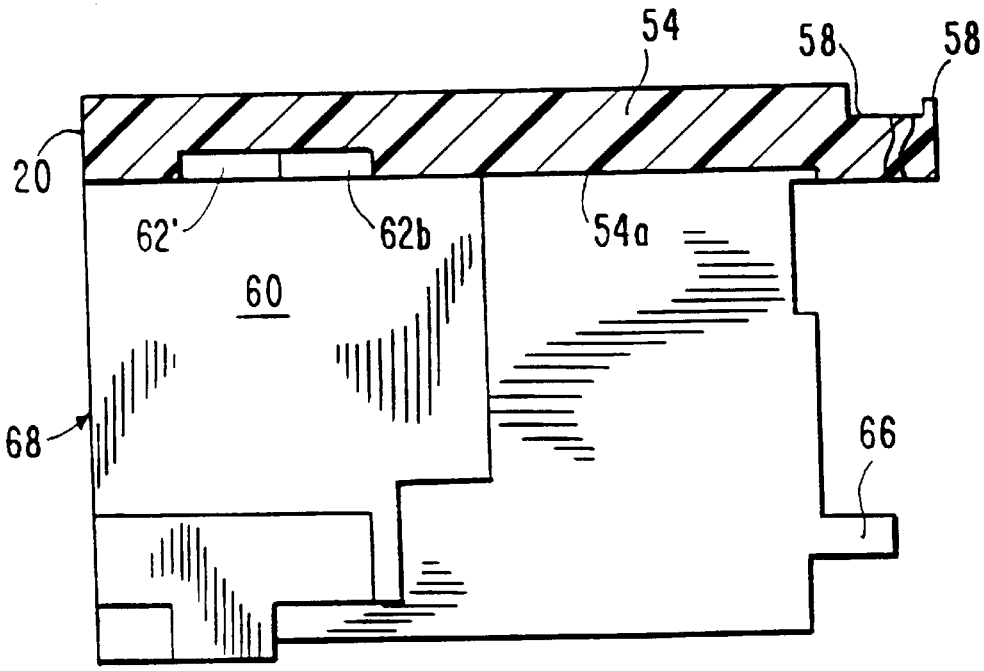
FIG. 5C is a cross-sectional view of the outer housing part shown in FIGS. 5 and 5A taken along the line 5C—5C of FIG. 5.
Figure 6:
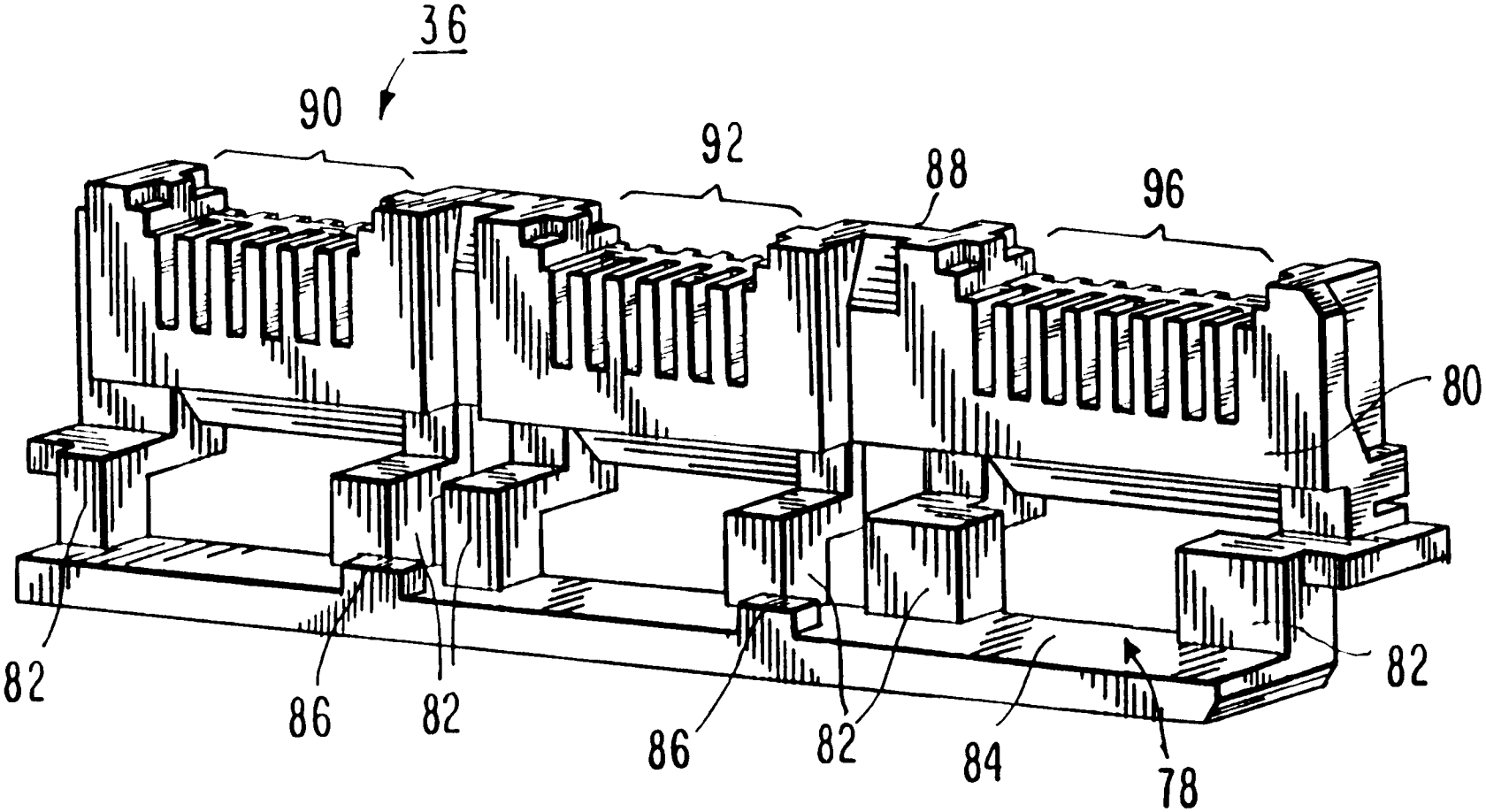
FIG. 6 is a perspective view of an inner housing part of the modular jack shown in FIG. 4.
Figure 7:
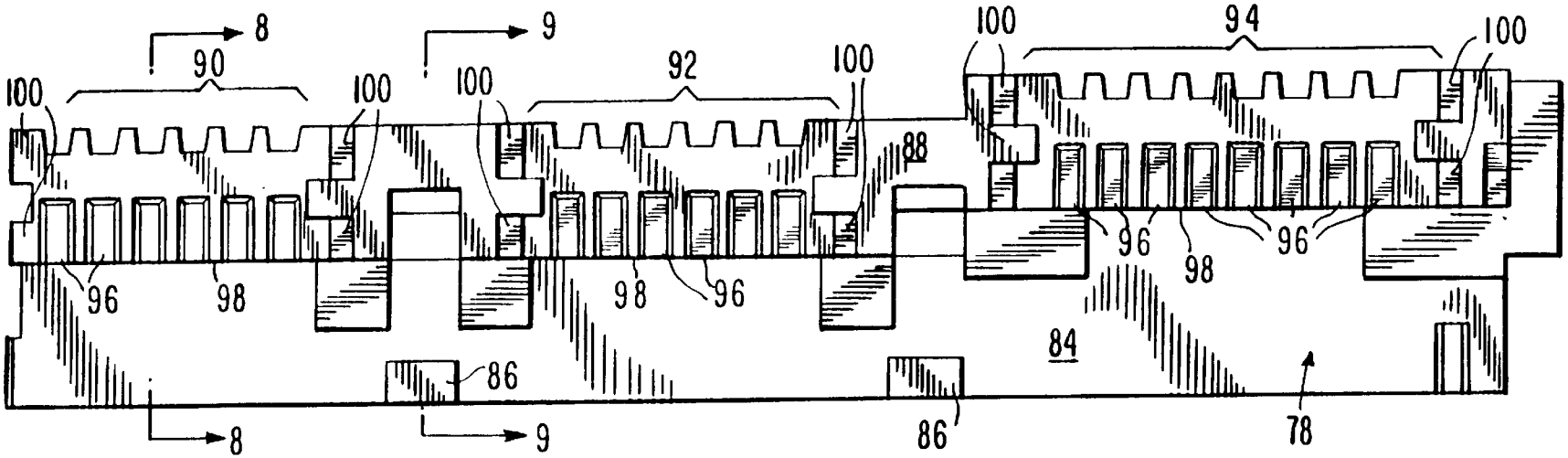
FIG. 7 is a top view of the inner housing part shown in FIG. 6.
Figure 9:
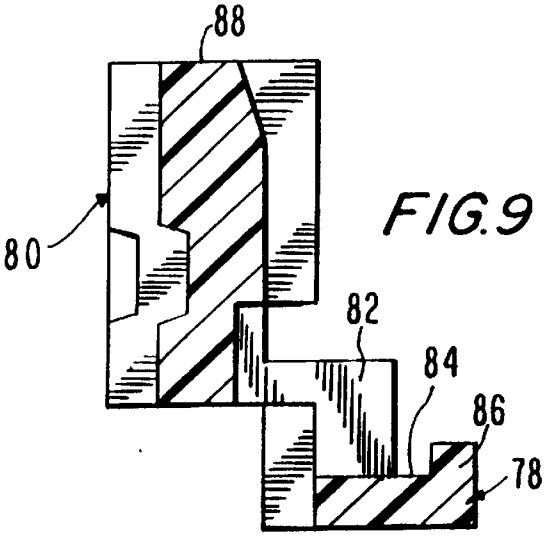
FIG. 9 is a view of the inner housing part shown in FIG. 6 taken along the line 9—9 of FIG. 7.

Referring to FIGS. 4–5C, the outer housing part 42 is a unitary member formed of dielectric material, such as a glass-filled thermoplastic material or glass-filled polyester, and has a front wall 52 which provides the front face 20 of the jack 14, a substantially planar top wall 54 which provides the upper surface 18 of the jack 14 and a pair of substantially planar side walls 56. The outer housing part 42 is essentially open on its bottom although a bottom plate may be provided to close the bottom of the outer housing part 42, i.e., once the jack 14 is assembled and mounted on the printed circuit board 30. Such a bottom plate may be part of the card 10. The top wall 54 extends beyond the side walls 56. Top wall 54 and side walls 56 include projections and receptacles 58 to facilitate connection to the card member 12. The front wall 52 is contiguous with inner surfaces 60 which define in part the plug-receiving receptacles 22, one of the inner surfaces 60 being the interior surface of a side wall 56. A guide member 66 is arranged at the bottom of the exterior surface of each side wall 56 to facilitate engagement of the jack 14 with the card member 12. A lower surface 54*a* of the top wall 54 has three inwardly recessed portions 62*a*, 62*b*, 62*c*, each recessed portion aligning with a respective one of the plug-receiving receptacles 22 and including grooves 62', the purpose of which is explained below (FIG. 5C). Each plug-receiving receptacle 22 is structured with guide surfaces and latch surfaces of standard configuration to receive a standard modular RJ-type plug. An interposed rigid housing portion 68 of the outer housing part 42 is thereby formed between each adjacent pair of plug-receiving receptacles 22, the inner surfaces 60 defining the plug-receiving receptacles 22 also defining the interposed portions 68. Each interposed portion 68 includes a bottom wall 70 providing part of the lower surface 26, an intermediate wall 72 and a recessed aperture 74 in the intermediate wall 72 (FIG. 5B).

Referring now to FIGS. 6–10, the inner housing part 36 of the inner housing assembly 44 is a unitary member formed of dielectric material, such as a glass-filled thermoplastic material or glass-filled polyester, and includes an elongate, planar base 78, a main body portion 80 and angled support elements 82 for supporting the main body portion 80 transversely offset from the base 78. The upper surface 84 of the base 78 includes projections 86, each adapted to fit into a respective, aligning recessed aperture 74 in the intermediate wall 72 of the interposed portions 68 when the inner housing assembly 44 is mated with the outer housing part 42. The main body portion 80 has an upper surface 88 and three longitudinally offset sections 90,92,94, each including a portion recessed from upper surface 88 having a set of guide slots 96 which extend partially along the front face 98 of the respective section of the main body portion 80. Section 94 is transversely offset with respect to sections 90 and 92. Two angled support elements 82 are arranged at each longitudinal end of each section 90,92,94. Recesses 100 are arranged in the upper surface 88 adjacent the recessed portion of each section 90,92,94. The function of recesses 100 is to mate with portions of the contact/terminal-retainer assemblies 38 in order to secure the contact/terminal retainer assemblies 38 to the inner housing part 36.

The set of guide slots 96 in each of sections 90,92 includes six guide slots whereas the set of guide slots 96 in the section 94 includes eight guide slots, although the number of guide slots in each section depends on the intended use of the jack 14 and may be varied as desired. The number of guide slots determines the type of contact/terminal-retainer assembly 38, i.e., each assembly having a different number of contact/terminal members 34, which can be placed in the sections 90,92,94 and thus the type of plug which can be received in the plug-receiving receptacle 22 cooperating with the contact/terminal-retainer assembly 38.

Figure 8:
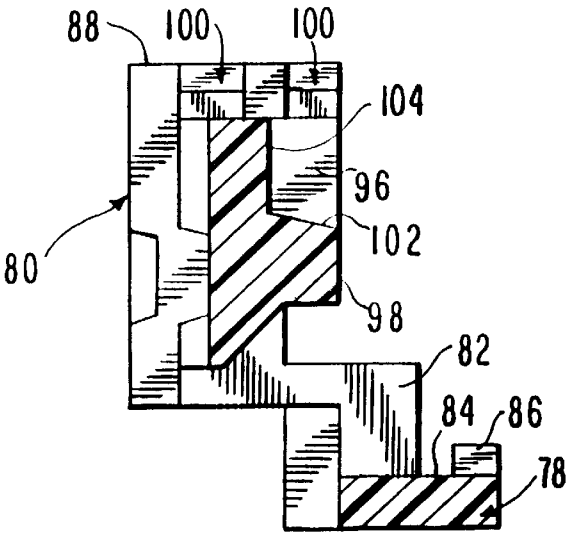
FIG. 8 is a view of the inner housing part shown in FIG. 6 taken along the line 8—8 of FIG. 7.

Each guide slot 96 is defined by an oblique surface 102 directly inwardly from the front face 98 of the main body portion 80 and a vertical rear surface 104 (FIG. 8). Guide slots 96 are designed to accommodate the end of the contact portion 34*a* of a respective contact/terminal member 34 in the event that a plug inserted into the plug-receiving receptacle 22 causes the contact portion 34*a* to be urged as far back as the slot 96. Guide slots 96 may extend entirely between the upper surface 88 and lower surface 81 of the front face 98 of the main body portion 80.

Figure 10:
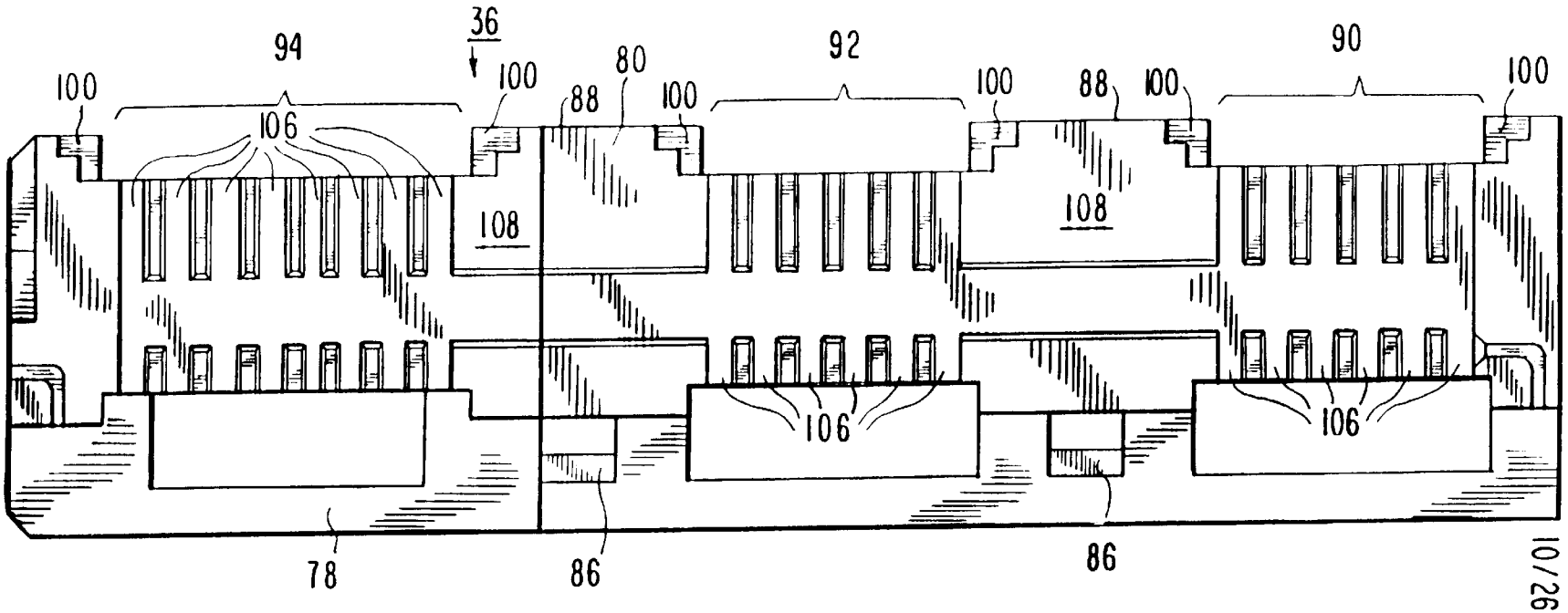
FIG. 10 is a rear view of the inner housing part shown in FIG. 6.

As shown in FIG. 10, guide slots 106 are formed in a rear face 108 of the main body portion 80 in alignment with each slot 96 in the front face 98 and are designed to receive a terminal portion 34*b* of a respective contact/terminal member 34.

The particular construction of the sections 90,92,94 of the inner housing part 36, e.g., three sections one of which is transversely offset from the others, depends on the type of RJ-connector to be incorporated into the jack 14. In the illustrated embodiment, two RJ-11 type connectors are used (accommodating a 6-position plug) and one RJ-45 type connector (accommodating an 8-position plug) is used and thus, the inner housing part 36 has the form shown. The transverse offset of section 94 relative to sections 90,92 is thus required in view of the dimensional difference between RJ-11 and RJ-45 type connectors. In embodiments wherein the jack 14 were designed to mate with only a single type of RJ plug, i.e., RJ-45 plugs, then a transverse offset of the sections of the main body portion would not be required. Other constructions of an inner housing part may be used in accordance with the invention.

Figure 11:
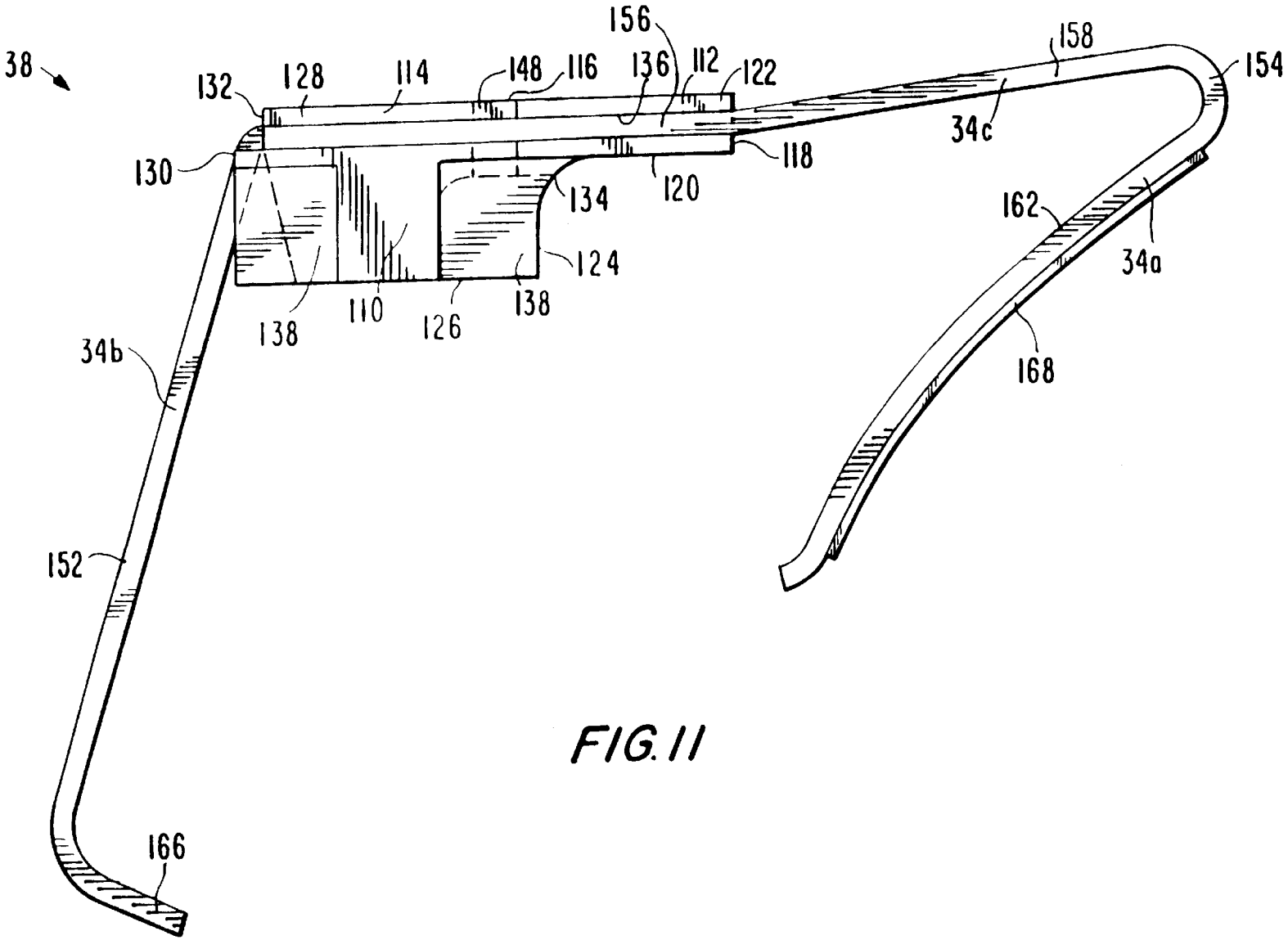
FIG. 11 is a side view of a first embodiment of the contact/terminal-retainer assembly for use in the modular jack shown in FIG. 1 showing the contact/terminal members in a bent state.
Figure 12:
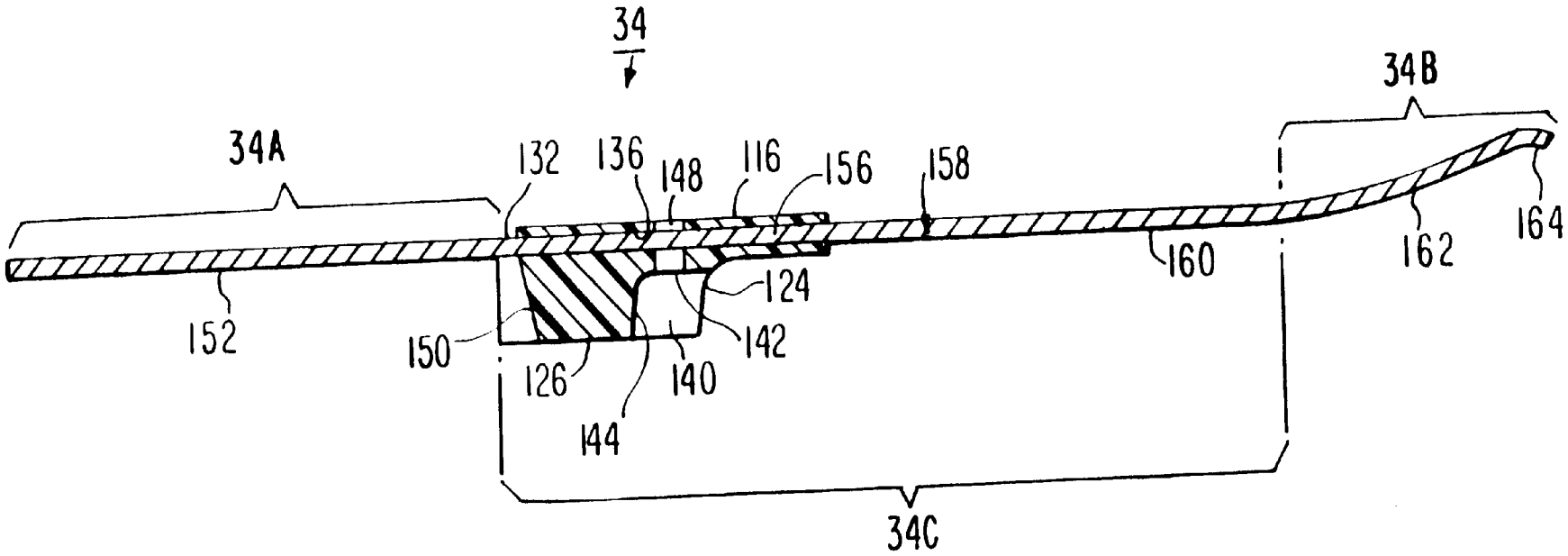
FIG. 12 is a cross-sectional view of the contact/terminal-retainer assembly shown in FIG. 11 prior to the contact/terminal members being bent into the shape shown in FIG. 11.
Figure 13:
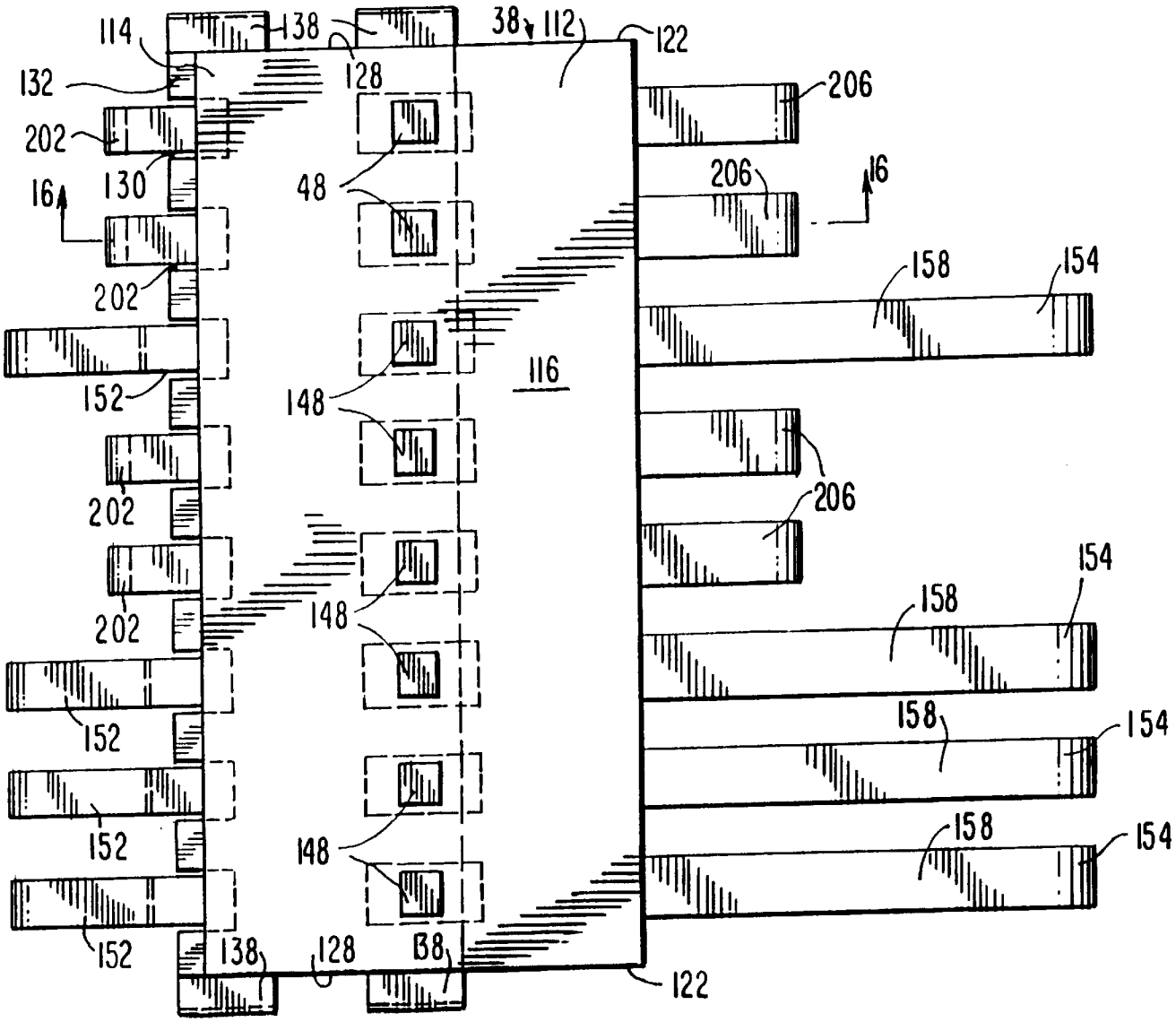
FIG. 13 is a top view of the contact/terminal-retainer assembly shown in FIG. 11.
Figure 14:
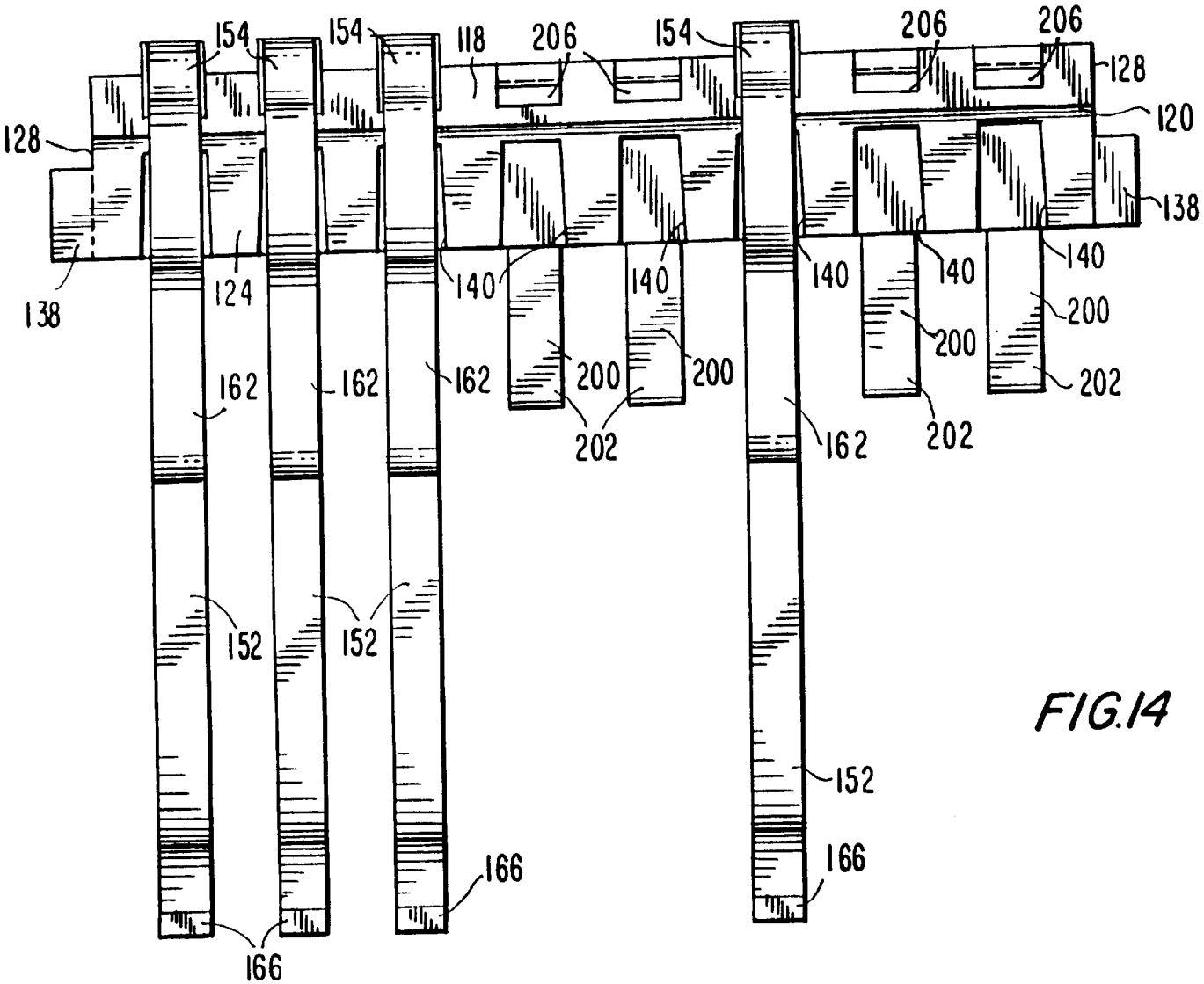
FIG. 14 is a front view of the contact/terminal-retainer assembly shown in FIG. 11.

Referring now to FIGS. 11–16, each contact/terminal-retainer assembly 38 includes a retainer housing 110 formed of dielectric material, such as a glass-filled thermoplastic material or glass-filled polyester, and a plurality of the contact/terminal members 34 mounted in connection with retainer housing 110. Retainer housing 110 has a front portion 112, a rear portion 114 having a larger height than the front portion 112 and a planar top wall 116 which extends contiguously over the front and rear portions 112, 114. Front portion 112 includes a front wall 118, a bottom wall 120 and side walls 122. Rear portion 114 includes a front wall 124, a bottom wall 126, side walls 128 and rear wall 130. Side walls 128 are contiguous with side walls 122. Rear wall 130 has a recessed ledge 132. A curved wall 134 connects the front wall 124 of rear portion 114 to the bottom wall 120 of front portion 112. A plurality of transverse channels 136 are formed in the retainer housing 110 and are each adapted to receive a respective contact/terminal member 34. Channels 136 extend from the front wall 118 of the front portion 112 to the recessed ledge 132 of the rear wall 130 of the rear portion 114. Mounting projections 138 are arranged on each side wall 128 of retainer housing 110 for enabling securing of the contact/terminal-retainer assembly 38 to the inner housing part 36. Slots 140 are formed in the rear portion 114, each in alignment with a respective one of the channels 136. Slots 140 extending inwardly from the front wall 124 and bottom wall 126 and are defined by a horizontal wall 142 and a vertical wall 144 connected by a curved wall portion 146 (FIG. 12). Further, apertures 148 are formed in the rear portion 114 of retainer housing 110 extending between the top wall 116 and the horizontal wall 142 of each slot 140. Slots 150 are formed in the rear wall 130 of the rear portion 114 in alignment with each channel 136 and extend obliquely from the recessed ledge 132 to the bottom wall 126 of the rear portion 114.

The contact/terminal-retainer assembly 38 includes contact/terminal members 34 having a particular form to enable the jack 14 to have a "reduced" vertical height (relative to jacks including existing, traditional contact/terminal members) while still providing sufficient normal contact force. As such, the overall height of the jack 14 may be less than about 10.5 mm, which is less than the overall height of conventional jacks of the RJ type (about 11.5 mm).

Initially, the contact/terminal members 34 have the form shown in FIG. 12 and are manipulated into the form shown in FIG. 11 for assembly into connection with the inner housing part 36. As shown in FIG. 12, upon formation of the contact/terminal-retainer assembly 38, each contact/terminal member 34 has a terminal section 34A, a contact section 34B and an intermediate bridging section 34C. Terminal section 34A includes a first elongate terminal portion 152 extending from the rear wall 130 of rear portion 114 of the housing 110 of the contact/terminal-retainer assembly 38. Intermediate bridging section 34C includes a second elongate bridging portion 156 situated in a respective channel 136 in the retainer housing 110 and a third elongate bridging portion 158 extending from the front wall 118 of front portion 110 of retainer housing 110 (the first, second and third elongate portions 152,156,158 all being situated in a substantially common plane 160). Contact section 34B includes an arcuate portion 162 connected to an end of the third elongate bridging portion 158 and extending at an angle away from the common plane 160 in which the first, second and third elongate portions 152,156,158 are situated, and a curved portion 164.

Prior to installation of the contact/terminal-retainer assemblies 38 in connection with the inner housing part 36 of the jack 14 to thereby form the inner housing assembly 44, the contact/terminal members 34 on the contact/terminal-retainer assemblies 38 are bent into the form shown in FIG. 11. Specifically, the first elongate terminal portion 152 of each contact/terminal member 34 is bent at a location adjacent the recessed ledge 132 of the rear wall 130 into the aligning slot 150 and a terminal-pad portion 166 is formed by bending the end of the first elongate terminal portion 152 inward. The third elongate bridging portion 158 is bent upward at a small angle until it is situated above the top wall 116 of the retainer housing 110 and then over itself to form a curve 154 and such that the curved contact portion 34*a* is formed from arcuate portion 162 of contact section 34C. Upon insertion of a mating plug into the receptacle into which the contact portions 34*a* extend, the contact blades of the plug will engage contact/terminal members 34 along curved contact portion 34*a*. To this end, contact portion 34*a* is typically provided with a coating 168 to increase electrical connection between contact/terminal members 34 and the contact blades of the mating plug.

The contact/terminal members 34 have a variable width along their length. In particular, the width of the intermediate bridging portion 34*c* of the contact/terminal members 34, including curved portion 154 which has a small bend radius, is greater than the width of the contact portion 34*b* in order to relieve stress.

The contact/terminal-retainer assembly 38 may include its full complement of eight contact/terminal members 34. In the alternative, referring to FIGS. 13–16, the contact/terminal-retainer assembly 38 may include one or more non-form contacts 200 which are not electrically connected to the printed circuit board 30 or the mating plug. The arrangement of contact/terminal members 34 and non-form contacts 200 in each contact/terminal-retainer assembly 38 depends on the configuration of the jack 14. Initially, the non-form contacts 200 have the form shown in FIG. 16. Each non-form contact 200 has a first elongate portion 202 extending from the rear wall 130 of rear portion 114 of contact/terminal-retainer assembly 38, a second elongate portion 204 situated in a respective channel 136 in the contact/terminal-retainer assembly 38 and a third elongate portion 206 extending from the front wall 118 of front portion 112 of contact/terminal-retainer assembly 38. The first, second and third elongate portions 202,204,206 are situated in the same plane 160 as the elongate portions 152,156,158 of the contact/terminal members 34. Prior to installation of the contact/terminal-retainer assemblies 38 in connection with the inner housing part 36 of the jack 14, the first elongate portion 202 of each non-form contact 200 is bent at a location adjacent the recessed ledge 132 of the rear wall 130 into an aligning slot 150.

Figure 17:
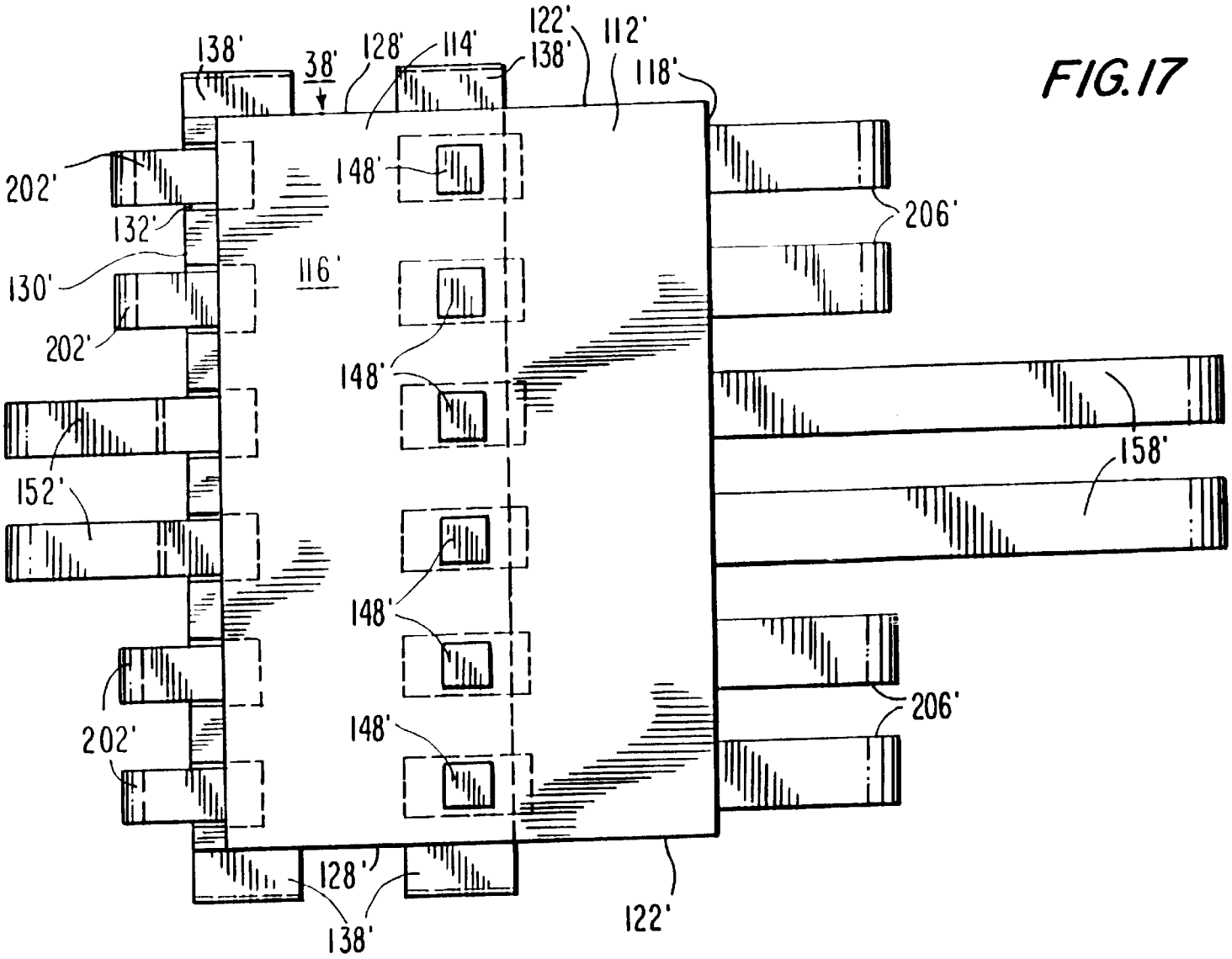
FIG. 17 is a top view of a second embodiment of the contact/terminal-retainer assembly for use in the modular jack shown in FIG. 1.
Figure 18:
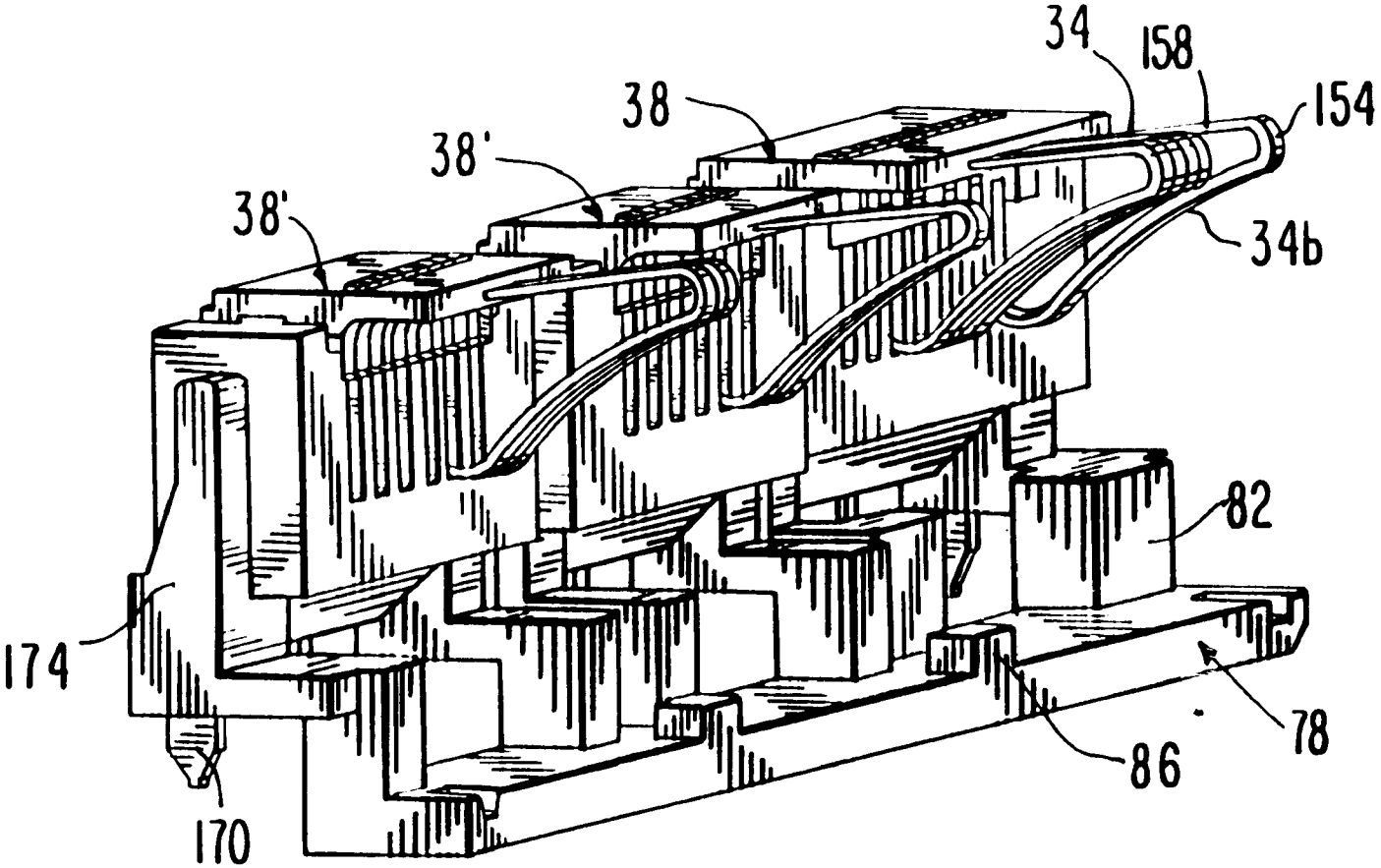
FIG. 18 is a left side perspective view of a jack sub-assembly of the contact/terminal-retainer assemblies shown in FIGS. 11–17 and the inner housing part shown in FIGS. 6–10.
Figure 19:
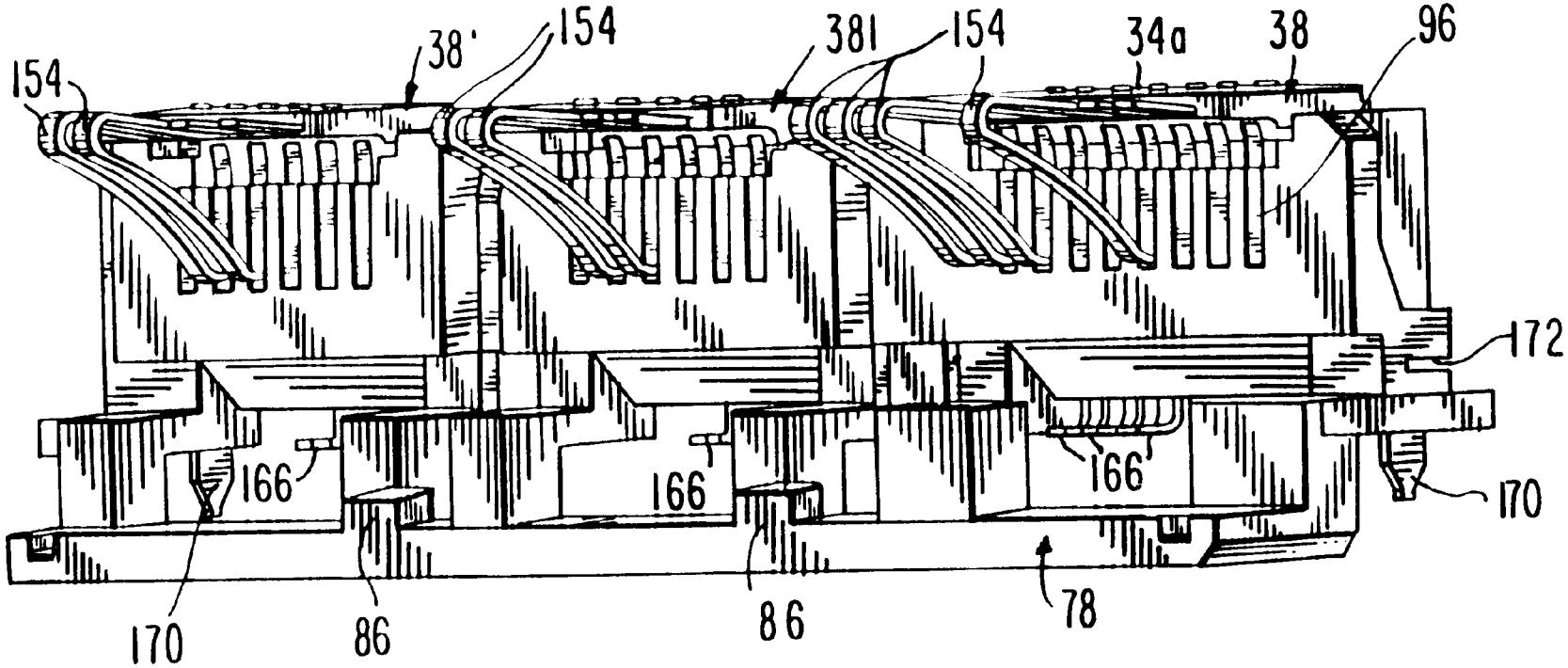
FIG. 19 is a right side perspective view of a jack sub-assembly of the contact/terminal-retainer assemblies shown in FIGS. 11–17 and the inner housing part shown in FIGS. 6–10.
Figure 20:
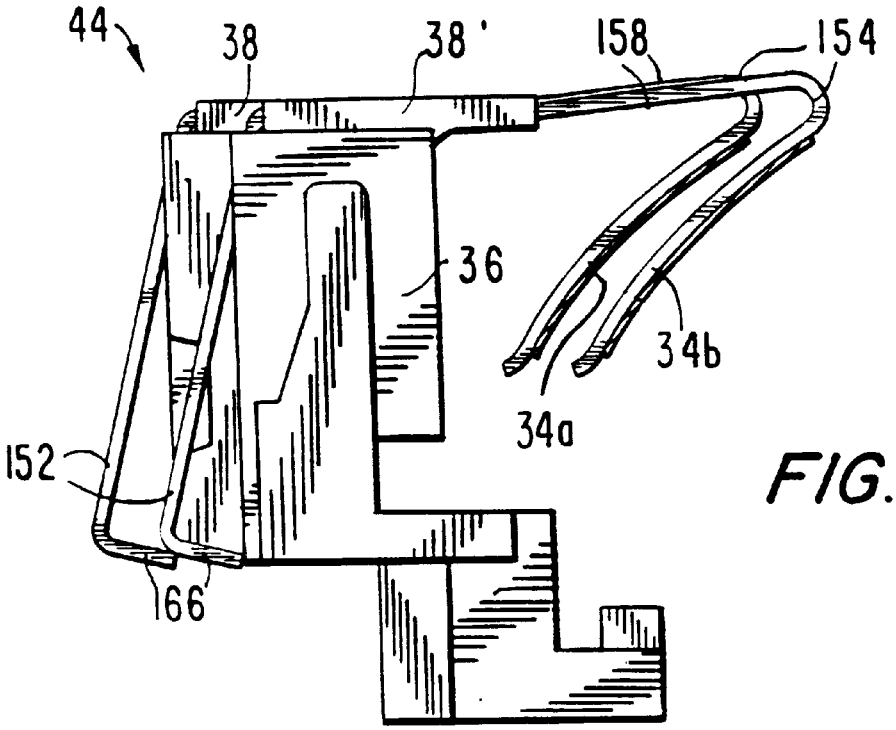
FIG. 20 is a left side view of the jack sub-assembly shown in FIG. 18 prior to placement of the terminal portion of the contact/terminal members in the slots in the rear face of the inner housing part.
Figure 23:
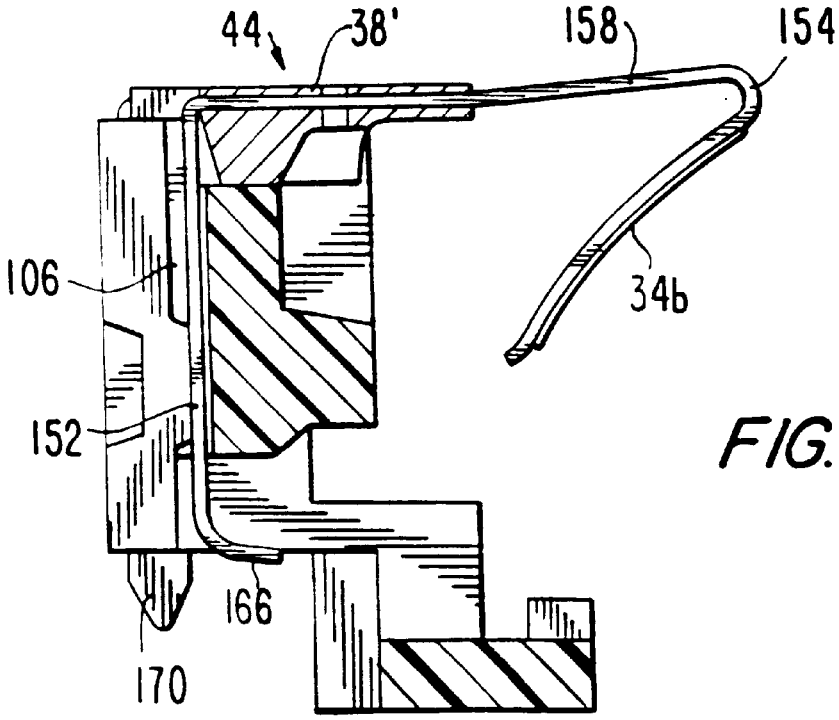
FIG. 23 is a cross-sectional view of the sub-assembly shown in FIG. 19 taken along the line 23—23 in FIG. 19 after placement of the terminal portion of the contact/terminal members in the slots in the rear face of the inner housing part.

FIG. 17 shows another embodiment of a contact/terminal-retainer assembly for use in the jack 14 in accordance with the invention, which is designated 38'. For the common elements of the contact/terminal-retainer assemblies 38 and 38', the reference numerals for these elements in FIG. 17 have been primed. The most significant structural difference between contact/terminal-retainer assembly 38' shown in FIG. 17 and contact/terminal-retainer assembly 38 shown in FIGS. 13–16 is the number of transverse channels 136 in the housing 110 and thus the maximum number of contact/terminal members 34 that can be arranged in connection therewith. Specifically, the housing 110' of contact/terminal-retainer assembly 38' includes only six channels 136' and has a corresponding reduced width whereas the housing 110 of contact/terminal-retainer assembly 38 includes eight channels 136. Otherwise, the contact/terminal-retainer assemblies 38 and 38' are essentially identical. Contact/terminal-retainer assemblies 38,38' are designed to fit in a respective one of the sections 90,92,94 of the main body portion 80 of the inner housing part 36.

Thus, contact/terminal-retainer assembly 38 is arranged in section 94, which allows for a maximum of eight contact/terminal members 34, and a contact/terminal-retainer assembly 38' is arranged in each of sections 90 and 92, which allows for a maximum of six contact/terminal members.

Figure 15:
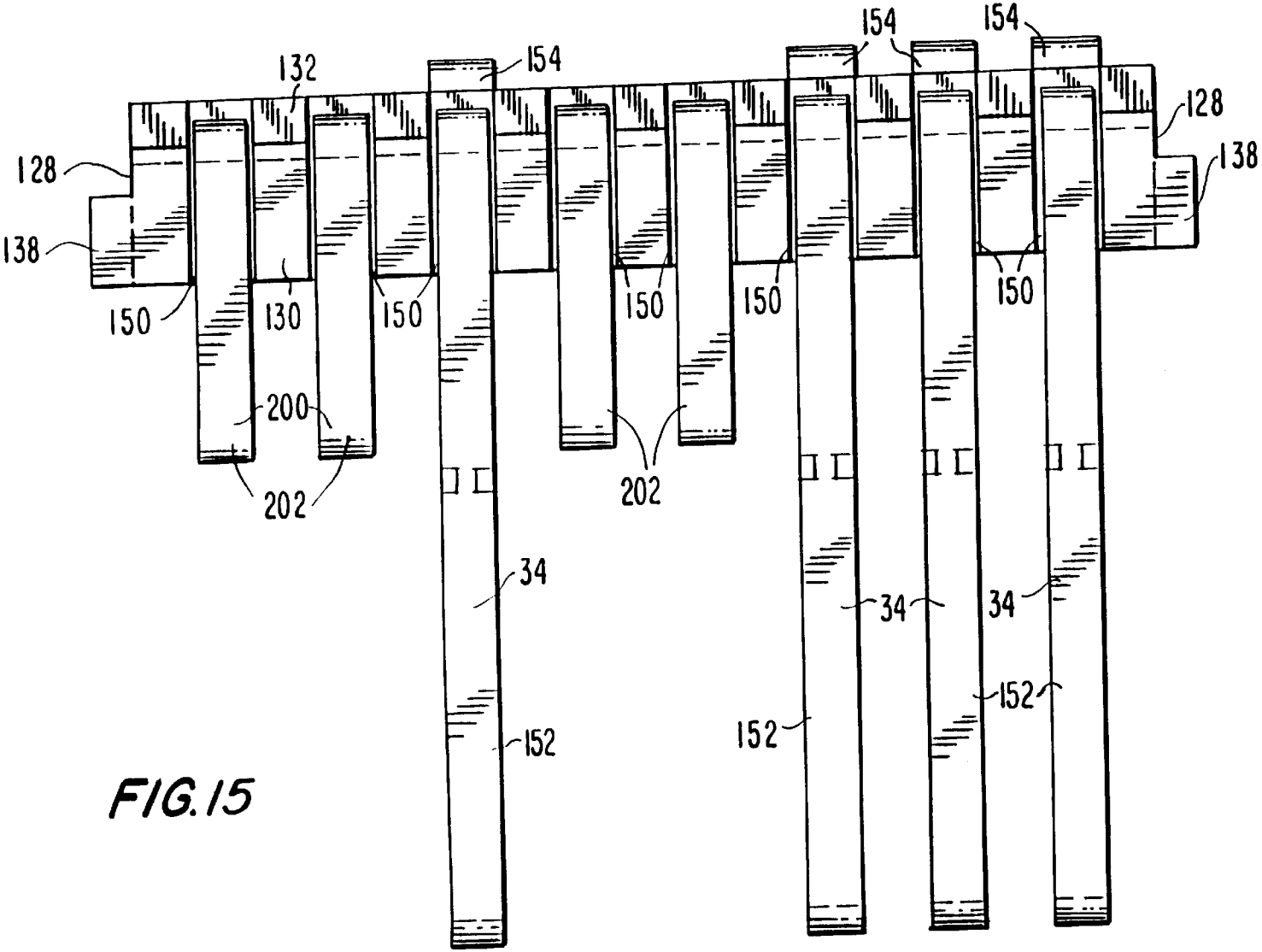
FIG. 15 is a rear view of the contact/terminal-retainer assembly shown in FIG. 11.
Figure 16:
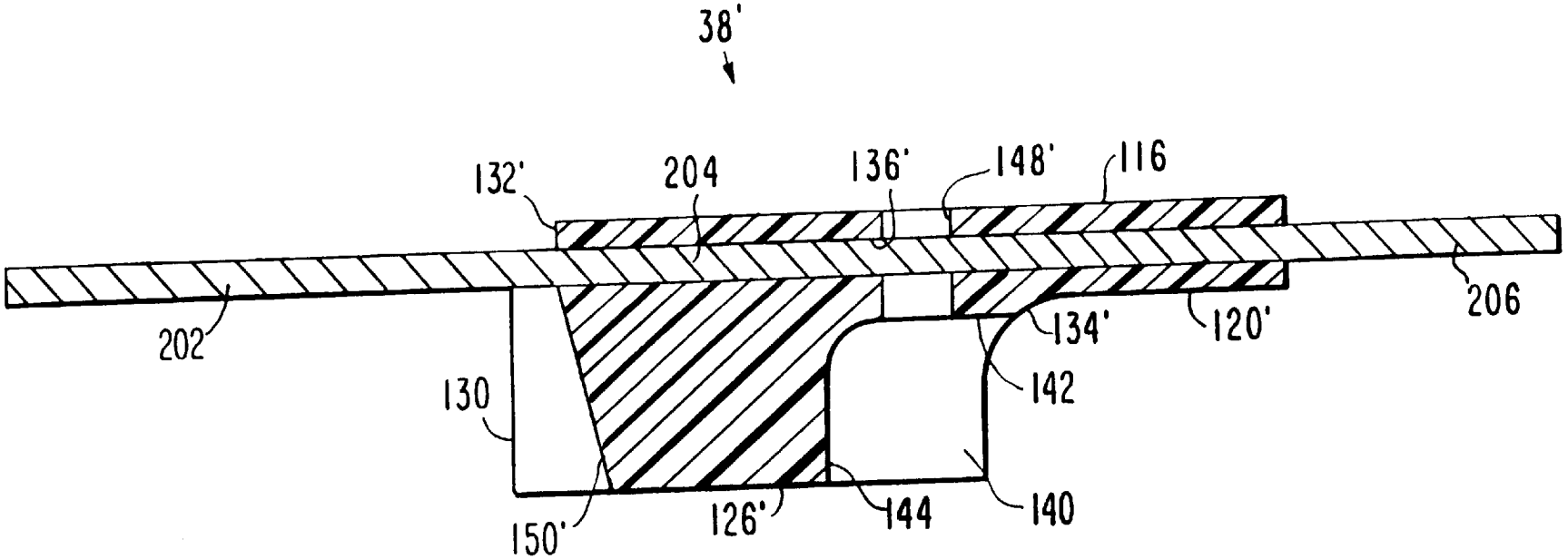
FIG. 16 is a cross-sectional view of the contact/terminal-retainer assembly shown in FIG. 11 taken along the line 16—16 in FIG. 13.

Furthermore, in the embodiments illustrated in FIGS. 13–16, the contact/terminal-retainer assembly 38 adapted to fit in section 94 of main body portion 80 of the inner housing part 36 includes four contact/terminal members 34 and four non-form contacts 200. The contact/terminal members 34 are placed in positions P3, P6, P7 and P8 and the non-form contacts 200 are placed in positions P1, P2, P4 and P5 (FIG. 15). The contact/terminal-retainer assembly 38' adapted to be placed in each of sections 90 and 92 of main body portion 80 includes two contact/terminal members 34 and four non-form contacts 200. The contact/terminal members 34 are placed in positions P3 and P4 and the non-form contacts 200 are placed in positions P1, P2, P5 and P6 (FIG. 17). The positions of the contact/terminal members 34 and non-form contacts 200 may be changed depending on the requirements of the jack 14.

Figure 21:
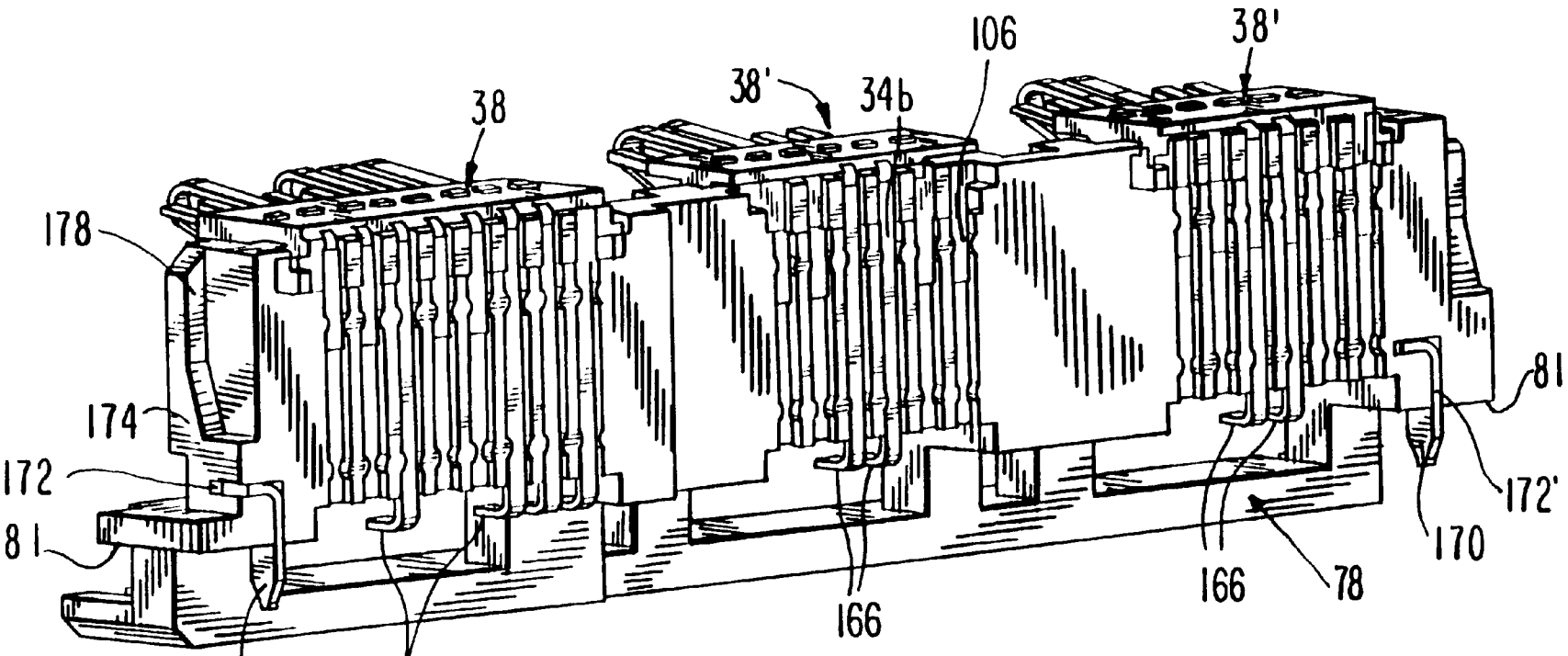
FIG. 21 is a rear perspective view of the sub-assembly of the modular jack shown in FIG. 19.
Figure 22:
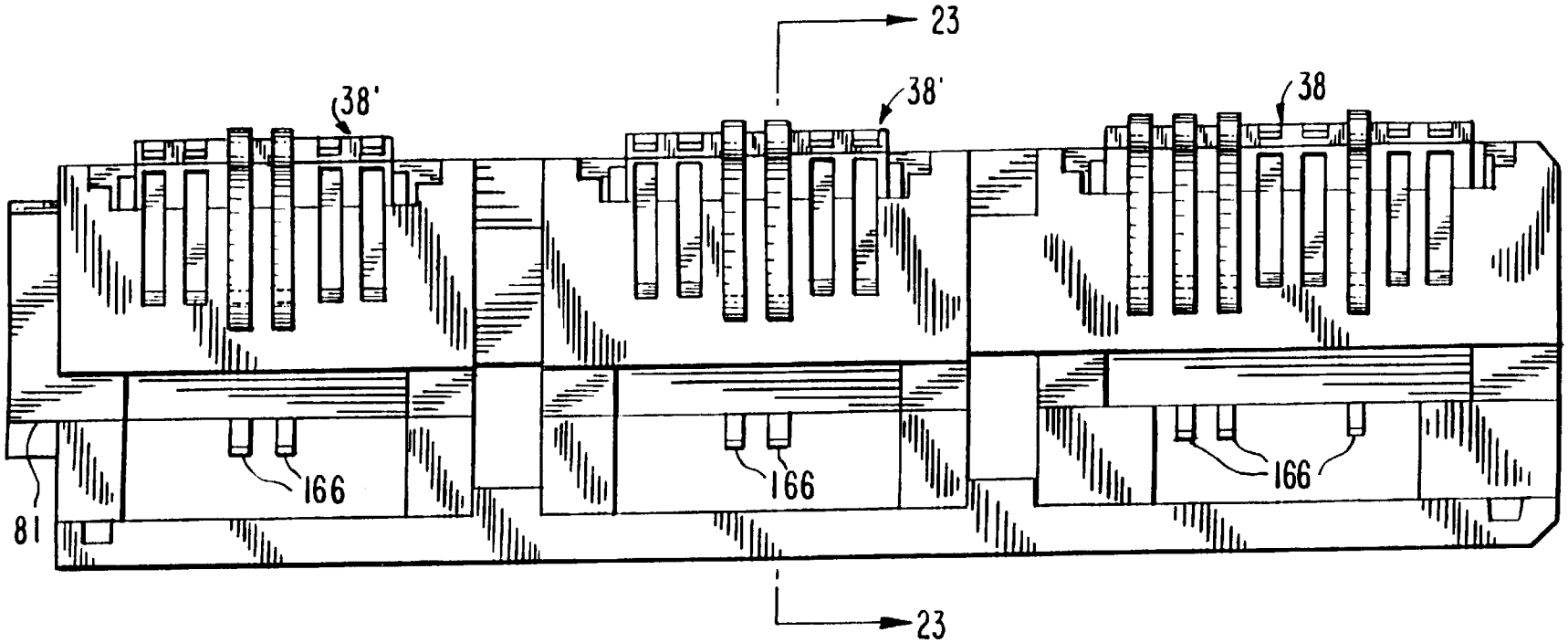
FIG. 22 is a rear view of the sub-assembly of the modular jack shown in FIG. 19.

Referring to FIGS. 18–23A, in the assembly of the jack 14, the inner housing assembly 44 is formed first. To this end, the contact/terminal-retainer assembly 38 is mounted in connection with section 94 of the main body portion 80 of the inner housing part 36 so that the terminal portions 34*c* of the contact/terminal members 34 are situated within a respective slot 106. A contact/terminal-retainer assembly 38' is mounted in connection with each of sections 90 and 92 of the main body portion 80 of the inner housing part 36 so that the terminal portions 34*c* of the contact/terminal members 34 are situated within a respective slot 106. The contact/terminal-retainer assemblies 38,38' are maintained in secure connection with the main body portion 80 by means of the cooperation between projections 138 on the side walls 128 of the contact/terminal-retainer assemblies 38,38' and the recesses 100 in the upper surface 88 of the main body portion 70. Other cooperating securing means for securing the contact/terminal-retainer assemblies 38,38' to the inner housing part 36 may be used in jacks in accordance with the invention instead of the recesses 100 and projections 138. The terminal-pad portion 166 of each contact/terminal member 34 is exposed in a space between the angled support members 82 to enable surface mounting of the contact/terminal members 34 to the printed circuit board 30. Solder tabs 170 are placed through slots 172,172' to enable the inner housing part 36 to be secured to the printed circuit board 30. Slot 172 extends from the side wall 174 to the lower surface 81 of the main body portion 80 of the inner housing part 36 and slot 172' extends from an interior of the main body portion 80 to the lower surface 81 of the main body portion 80 (FIG. 21).

The inner housing assembly 44 of the contact/terminal-retainer assemblies 38,38' and inner housing part 36 is then placed in the outer housing part 42. To this end, the side wall 56 alongside receptacle 58 includes a projection 176 which is adapted to fit within recess 178 on the side wall 174 of the main body portion 80 of the inner housing part 36 (FIG. 21). Further, projections 86 on the upper surface 84 of the base portion 80 of the inner housing part 36 fit into a respective, aligning recessed aperture 74 in the intermediate wall 72 of the interposed portions 68 of the outer housing part 42. During or after assembly of the jack 14, the terminal-pad portions 166 are soldered to contact regions on the printed circuit board 30.

In accordance with the invention, the contact/terminal-retainer assemblies 38,38' and the outer housing part 42 are constructed such that the recessed portion 62*a* in the lower surface 54*a* of the top wall 54 of the outer housing part 42 aligns with the contact/terminal-retainer assembly 38' placed into section 90 of the inner housing part 36, the recessed portion 62*b* in the lower surface 54*a* of the top wall 54 of the outer housing part 42 aligns with the contact/terminal-retainer assembly 38' placed into section 92 of the inner housing part 14 and the recessed portion 62*c* in the lower surface 54*a* of the top wall 54 of the outer housing part 42 aligns with the contact/terminal-retainer assembly 38, which is placed into section 94 of the inner housing part 42. Each contact/terminal member 34 of the contact/terminal-retainer assemblies 38,38' extends into a respective groove 62' in the lower surface 54*a* of the top wall 54 of the outer housing part 42. Thus, the grooves 62' are formed in the lower surface 54*a* of the top wall 54 of the outer housing part 42 at least in correspondence with the locations at which contact/terminal members 34 are placed in the contact/terminal-retainer assemblies 38,38'.

Figure 23A:
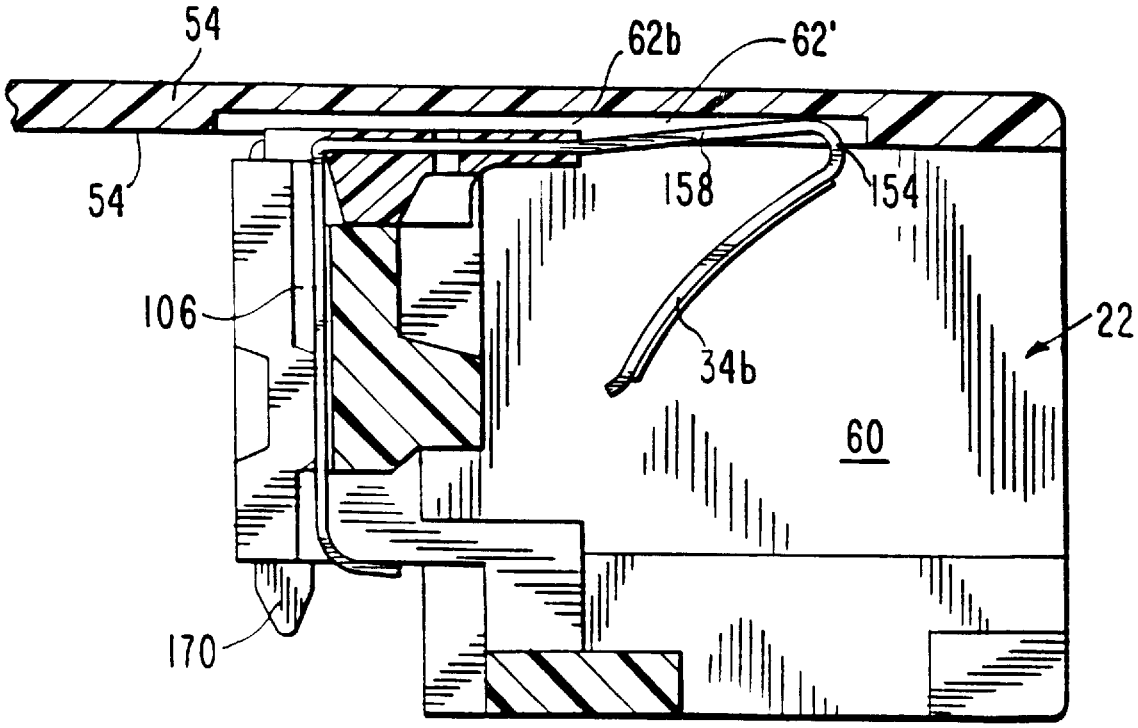
FIG. 23A is a cross-sectional view of the sub-assembly shown in FIG. 19 taken along the line 23—23 in FIG. 19 as it appears after placement of the sub-assembly in connection with the outer housing part.

As shown in FIG. 23A, only a very short region of the intermediate bridging portion 34*c* of the contact/terminal members 34 bears against the top wall 54 of the outer housing part 42, i.e., along the curve 154 leading to contact portion 34*a* of the contact/terminal member 34. This would thus constitute a "point contact" between the contact/terminal members 34 and the lower surface 54*a* of the top wall 54 of the outer housing part 42. The intermediate bridging portion 34*c* thus bears against the top wall 54 of the outer housing part 42 only at the curved portion and is spaced from the top wall 54 in view of its upward inclination from the inner housing assembly 44. The particular construction of the contact/terminal members 34 and housing therefor, as described above, enables the height of the jack 14 in accordance with the invention to be less than conventional jacks of the RJ type. Further, an advantage realized by means of this construction is that it is possible to pre-stress the contact/terminal members 34 when assembling the jack 14, e.g., by pressing the contact/terminal members 34 against the lower surface 54*a* of the top wall 54 of the outer housing part 42.

Thus, a communications card including a jack in accordance with the invention has been described. In another embodiment of the jack in accordance with the invention, for use in general electrical applications requiring an RJ-type jack, the jack include an outer housing part including a top wall, bottom wall and side walls defining a single plug-receiving receptacle opening at the front face of the outer housing part (similar to that shown in U.S. Pat. No. 4,703,991). In accordance with the invention, the top wall of the outer housing part is provided with a recess and grooves adapted to align with the contact/terminal receiving members of the inner housing assembly. The inner housing assembly includes an inner housing part having a main body portion having only a single section (instead of the main body portion 80 described above which includes three sections 90,92,94). Other modifications to the main body portion 80 would also be made in view of the reduction in the number of sections, e.g., its length would be that of a single section and the projections 86 between adjacent sections 90,92,94 would not be present. The inner housing assembly would also include a single contact/terminal-retainer assembly 38,38'. The section would be constructed to receive either contact/terminal-retainer assembly 38 with a possible full complement of eight contact/terminal members 34 or contact/terminal-retainer assembly 38' with a possible full complement of six contact/terminal members 34. Also, although the jack 14 would be designed to accommodate a printed circuit board within the height of the jack, it is also conceivable that the terminal portions 34*c* of the contact/terminal members 34 be extended for surface mounting of the jack onto a surface of a printed circuit board.

Figure 24:
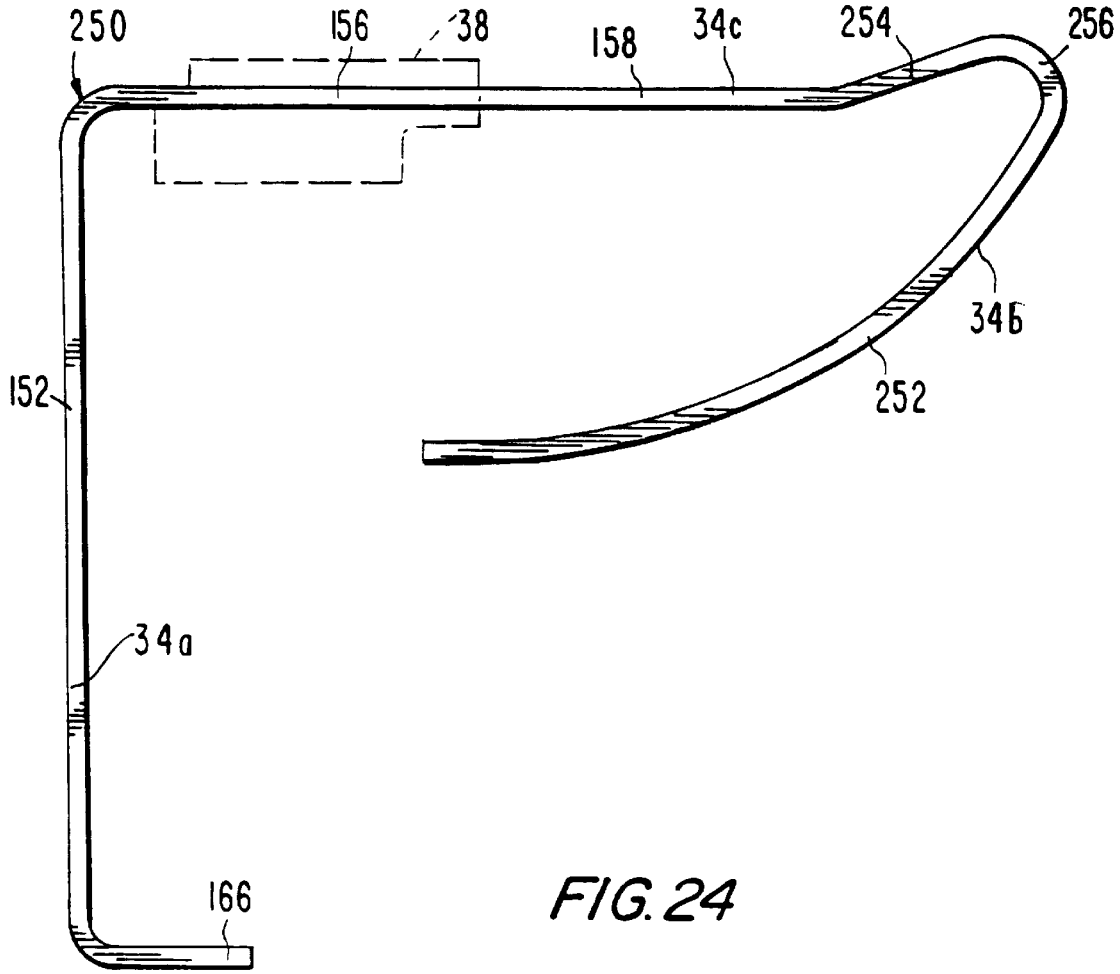
FIG. 24 is a front elevation view of another construction of a contact/terminal member for use in a modular jack in accordance with the invention.

An alternative contact/terminal member for use in the contact/terminal-retainer assemblies 38 described above is designated generally as 250 in FIG. 24 in its assembled condition. The same reference numerals designate the same features as for the contact/terminal members 34. Contact/terminal member 250 differs from contact/terminal members 34 in that the bridging portion 34*c* includes an elongate section 158 extending from the contact/terminal-retainer assembly 38 (shown in phantom lines) and an obliquely inclined portion 254 extending from the elongate section 158 to the curved section 256. Contact/terminal member 250 also includes a convex contact portion 252 which is adapted to engage with a respective contact portion of a mating plug. The presence of the upward inclination of the bridging portion (inclined portion 254), curve 256 leading to the contact portion 252 and convex contact portion 252 is designed to enable the contact portion 252 to have the required spring-back force required by applicable FCC requirements for RJ-type connectors while enabling a jack including such contact/terminal members 250 to have a lower profile than conventional RJ-type jacks as discussed above.

Figure 25:
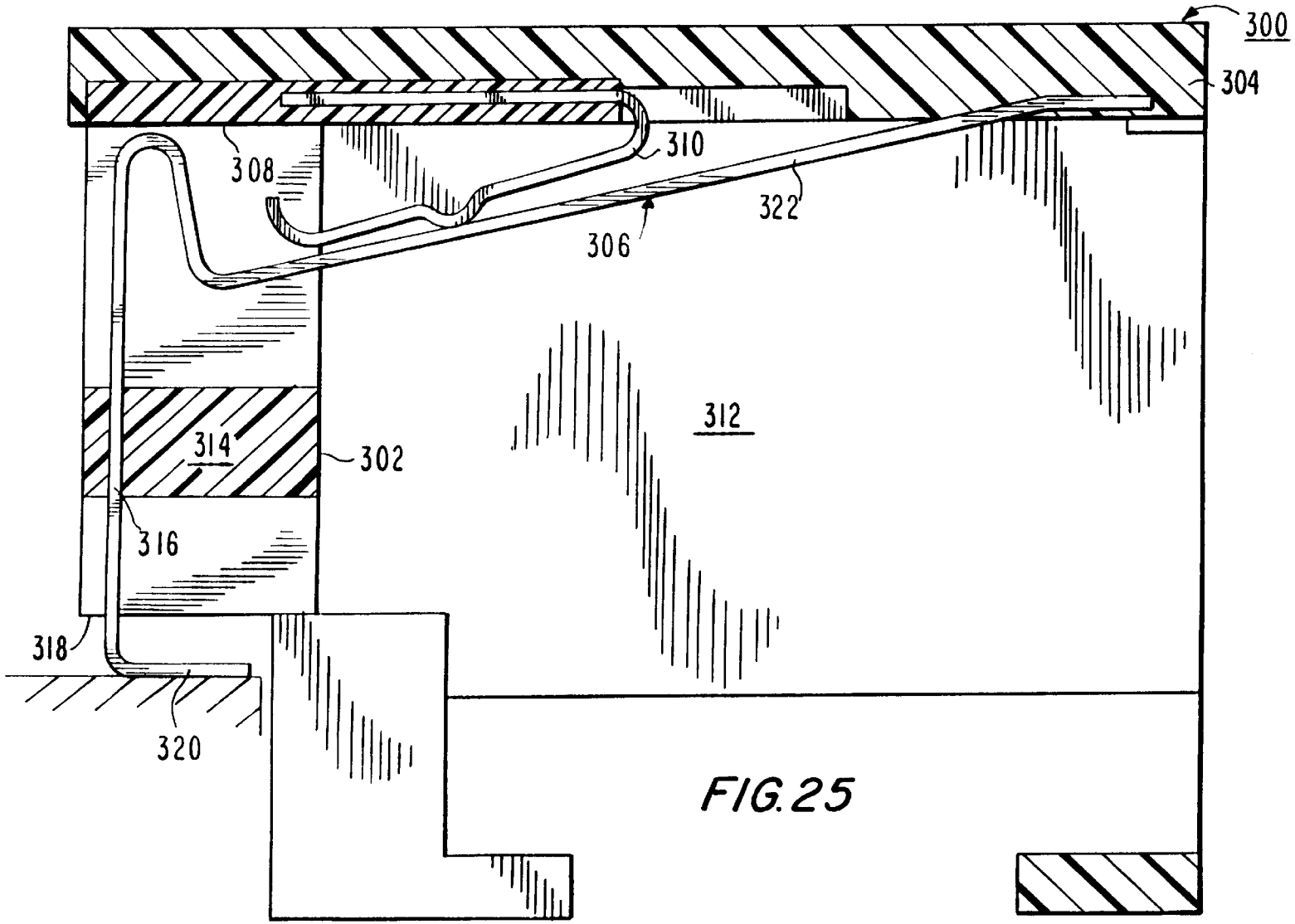
FIG. 25 is a cross-sectional view of a second embodiment of a modular jack in accordance with the invention.

FIG. 25 shows a cross-sectional view of a second embodiment of a modular jack in accordance with the invention designated generally as 300. Jack 300 includes an inner housing part 302, an outer housing part 304 defining at least one plug-receiving receptacle 312 and contact/terminal members 306 having a terminal portion 320 for enabling electrical connection to a printed circuit board (not shown) and a contact portion 322 extending into the plug-receiving receptacle 312. Inner housing part 302 includes slots 314 and channels 316 for retaining contact/terminal members 306. Contact/terminal members 306 are "forward-facing" in the sense that the contact portion 322 has a front end closer to the entrance of the receptacle 312, and which is situated within a recess in the outer housing part 304, and is obliquely inclined rearward toward the inner housing part 302. Outer housing part 304 including a spring mounting member 308 which retains back-up springs 310. Each spring 310 engages with the contact portion 322 of a respective one of the contact/terminal members 306 to provide a resilient force thereto. Features of the outer housing part 42 and inner housing part 36 described above may be incorporated into the outer housing part 304 and inner housing part 302, respectively. The use of forward facing contact/terminal members, in combination with the rearward facing contact/terminal members 34,250 described above provides certain advantages with respect to crosstalk reduction as disclosed in U.S. Pat. No. 5,639,266 (Patel).

Figure 26:
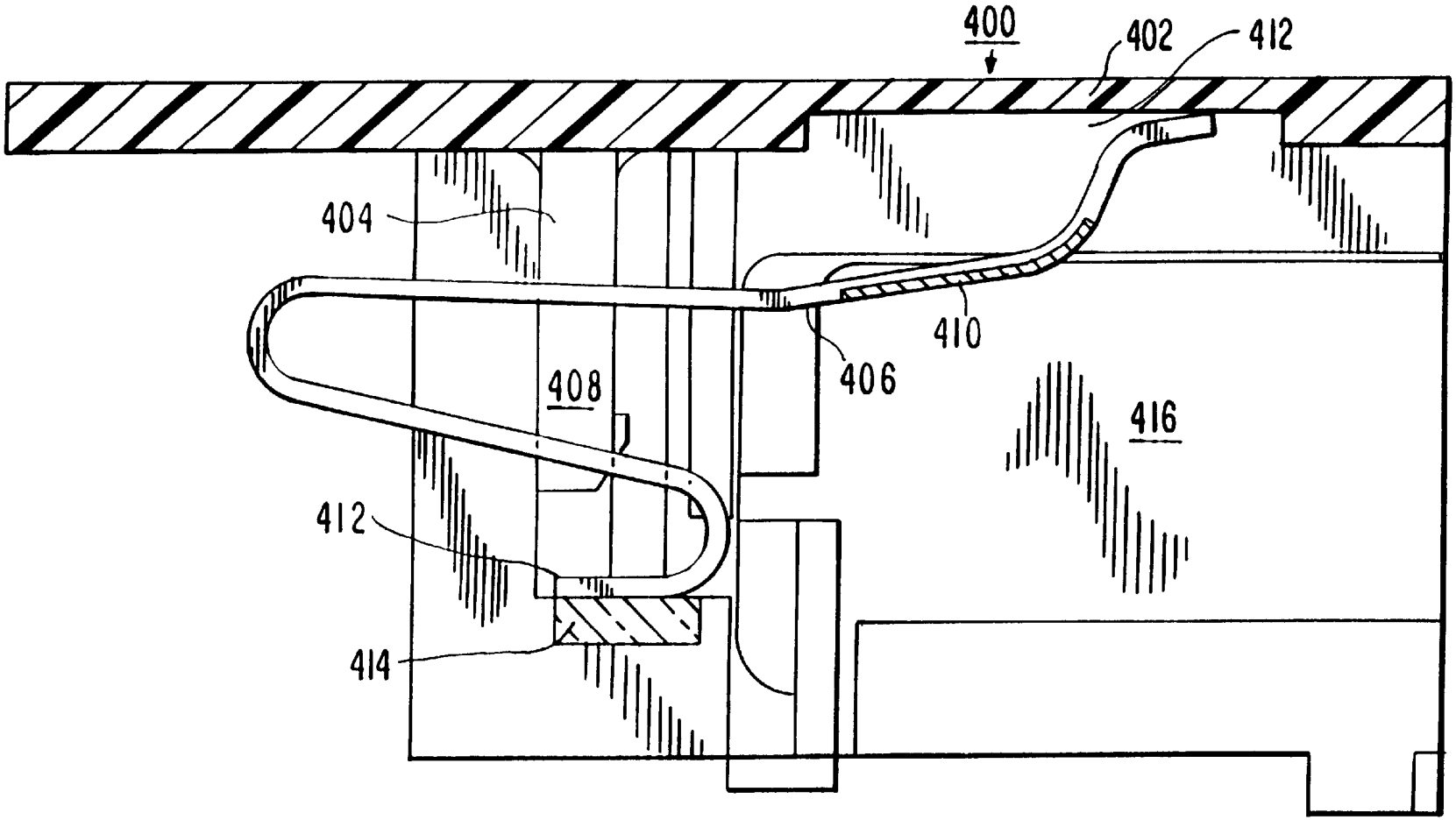
FIG. 26 is a cross-sectional view of a third embodiment of a modular jack in accordance with the invention.

FIG. 26 shows a cross-sectional view of a third embodiment of a modular jack in accordance with the invention designated generally as 400. Jack 40 includes an outer housing part 402, an inner housing part 404 defining at least one plug-receiving receptacle 416 and contact/terminal members 406, each having a terminal portion 412 electrically connected to a printed circuit board 414 and a contact portion 410 extending into the plug-receiving receptacle 416. Inner housing part 404 includes slots 408 for retaining contact/terminal members 406. Contact/terminal members 406 are "forward-facing" in the sense that the contact portion 410 has a front end closer to the entrance of the receptacle 416, and which is situated within a recess in the outer housing part 402, and is obliquely inclined rearward toward the inner housing part 404. Features of the outer housing part 42 and inner housing part 36 described above may be incorporated into the outer housing part 402 and inner housing part 402, respectively. The use of forward facing contact/terminal members, in combination with the rearward facing contact/terminal members 34,250 described above provides certain advantages with respect to crosstalk reduction.

Obviously, numerous modifications and variations of the present invention are possible in light of the above teachings. Accordingly, it is understood that other embodiments of the invention are possible in the light of the above teachings. For example, although a two-piece inner housing assembly is shown in the some of the illustrated embodiments, it is possible to construct a single-piece inner housing assembly. Also, although the contact/terminal-retainer assemblies in the jacks shown herein include contact/terminal members in accordance with the invention to provide the jacks with a low profile, if so desired, the same components (outer housing part, inner housing part and contact/terminal-retainer assembly housing) could be used in conjunction with other contact/terminal members which might not necessarily have a height lower than a conventional RJ-type jack. That is, the use of the outer housing part, inner housing part and contact/terminal-retainer assembly housing is not limited to low profile jacks and each of these components can be used, either individually or in combination with one or both of the others, in other modular jack applications.

We claim:

1. A modular electrical jack, comprising:

an outer housing part, and an inner housing assembly connected to said outer housing part and defining at least one plug-receiving receptacle with said outer housing part, said receptacle opening at a front of said outer housing part, said inner housing assembly including contact/terminal members, at least one of said contact/terminal members including a terminal portion adapted to be connected to a substrate, an arcuate contact portion extending into a respective one of said at least one plug-receiving receptacle and an intermediate bridging portion connecting said terminal portion and said contact portion, said contact portion having a free end facing a rear of said outer housing part, a portion of said bridging portion being inclined in relation to an inner surface of said outer housing part such that only a very short region of said bridging portion bears against an inner surface of said outer housing part, said short region of said bridging portion being closer to said front of said outer housing part than said free end of said contact portion.

2. The jack of claim 1, wherein said inner housing assembly comprises an inner housing part and at least one discrete contact/terminal-retainer assembly, at least one of said contact/terminal members being arranged in each of said at least one contact/terminal-retainer assembly.

3. The jack of claim 2, wherein said at least one contact/terminal-retainer assembly includes a retainer housing, said bridging portion including an elongate section extending obliquely upward and outward from said retainer housing terminating in a curved section, a portion of said curved section bearing against said inner surface of said outer housing part and remaining portions of said bridging portion being spaced from said inner surface.

4. The jack of claim 1, wherein said outer housing part includes a top wall having an inner surface including recessed grooves, said short region of said bridging portion of each of said at least one contact/terminal member being arranged in a respective one of said grooves.

5. The jack of claim 1, wherein said at least one contact/terminal-retainer assembly comprises a plurality of contact/terminal-retainer assemblies and said at least one plug-receiving receptacle comprises a plurality of plug-receiving receptacles.

6. The jack of claim 5, wherein said outer housing part has a height not greater than 10.5 mm and includes an interposed rigid housing portion formed by said inner surfaces between each adjacent pair of said plug-receiving receptacles, each of said interposed portions including a bottom wall, an intermediate wall and a recessed aperture in said intermediate wall.

7. The jack of claim 5, wherein said inner housing part includes a main body portion defining a receiving section for each of said at least one contact/terminal-retainer assembly.

8. The jack of claim 7, wherein said main body portion includes an elongate, planar base and angled support elements for supporting said main body portion over said base.

9. The jack of claim 7, wherein said outer housing part includes an interposed rigid housing portion formed by said inner surfaces between each adjacent pair of said plug-receiving receptacles, each of said interposed portions including a bottom wall, an intermediate wall and a recessed aperture in said intermediate wall.

10. The jack of claim 7, wherein said inner housing part includes guide slots formed in a rear face of said main body portion in alignment with each of said slots, said terminal portion of each of said at least one contact/terminal members being retained in a respective one of said guide slots.

11. The jack of claim 2, wherein said retainer housing of each of said at least one contact/terminal-retainer assembly includes a plurality of transverse channels each retaining one of said at least one contact/terminal member.

12. The jack of claim 2, further comprising cooperating securing means arranged on said inner housing part and said at least one contact/terminal-retainer assembly for securing said retainer housing of each of said at least one contact/terminal-retainer assembly to said inner housing part.

13. The jack of claim 1, wherein said contact portion is concave.

14. The jack of claim 1, wherein said contact portion is convex.

15. A modular electrical jack, comprising:

an outer housing part, and an inner housing assembly arranged in an interior of said outer housing part and defining at least one plug-receiving receptacle with said outer housing part, said inner housing assembly comprising an inner housing part, and at least one contact/terminal-retainer assembly mounted in connection with said inner housing part and in alignment with a respective one of said at least one plug-receiving receptacle, each of said at least one contact/terminal-retainer assembly including a retainer housing and a plurality of elongate contact/terminal members formed of conductive material, at least one of said contact/terminal members including a contact portion extending into the respective one of said at least one plug-receiving receptacle, a terminal portion mounted in said inner housing part, and an intermediate bridging portion connecting said terminal portion and said contact portion and arranged at least partially in said retainer housing, said bridging portion being fixedly secured to said retainer housing to prevent movement of said bridging portion relative to said retainer housing.

16. The jack of claim 15, wherein said contact portion is arcuate and a portion of said bridging portion is inclined in relation to an inner surface of said outer housing part such that only a very short region of said inclined bridging portion bears against said inner surface of said outer housing part.

17. The jack of claim 16, wherein said outer housing part includes a top wall having an inner surface including recessed grooves, said short region of said bridging portion of each of said at least one contact/terminal member being arranged in a respective one of said grooves.

18. The jack of claim 16, wherein said contact portion is concave.

19. The jack of claim 16, wherein said contact portion is convex.

20. The jack of claim 15, wherein said contact portion is arcuate and said bridging portion includes an elongate section extending obliquely upward and outward from said retainer housing to a level above an upper wall of said retainer housing and terminates in a curved section, a portion of said curved section bearing against an inner surface of said outer housing part.

21. The jack of claim 15, wherein said at least one contact/terminal-retainer assembly comprises a plurality of contact/terminal-retainer assemblies.

22. The jack of claim 15, wherein said outer housing part has a front wall, a pair of substantially planar side walls, a substantially planar top wall extending beyond said side walls, and inner surfaces contiguous with said front wall, said outer housing part including an interposed rigid housing portion formed by said inner surfaces between each adjacent pair of said plug-receiving receptacles, each of said interposed portions including a bottom wall, an intermediate wall and a recessed aperture in said intermediate wall.

23. The jack of claim 15, wherein said inner housing part includes a main body portion defining a receiving section for each of said at least one contact/terminal-retainer assembly, said main body portion including an elongate, planar base and angled support elements for supporting said main body portion over said base.

24. The jack of claim 15, further comprising cooperating securing means arranged on said inner housing part and said at least one contact/terminal-retainer assembly for securing said retainer housing of each of said at least one contact/terminal-retainer assembly to said inner housing part.

25. A multi-port modular electrical jack, comprising:

an outer housing part, and an inner housing assembly arranged in an interior of said outer housing part and defining plug-receiving receptacles with said outer housing part, said inner housing assembly comprising an inner housing part, and discrete contact/terminal-retainer assemblies mounted in connection with said inner housing part and in alignment with a respective one of said plug-receiving receptacles, each of said contact/terminal-retainer assemblies including a plurality of elongate contact/terminal members formed of conductive material, each of said contact/terminal members including a contact portion extending through the respective plug-receiving receptacle, a terminal portion mounted in said inner housing part, and an intermediate bridging portion connecting said terminal portion and said contact portion.

26. The jack of claim 25, wherein said contact portion is arcuate and a portion of said bridging portion is inclined in relation to an inner surface of said outer housing part such that only a very short region of said bridging portion bears against said inner surface of said outer housing part.

27. The jack of claim 26, wherein said contact portion is concave.

28. The jack of claim 26, wherein said contact portion is convex.

29. The jack of claim 26, wherein said outer housing part includes a top wall having an inner surface including recessed grooves, said short region of said bridging portion of each of said contact/terminal members being arranged in a respective one of said grooves.

30. The jack of claim 25, wherein each of said contact/terminal-retainer assemblies includes a housing, said contact portion being arcuate and said bridging portion including an elongate section extending obliquely upward and outward from said housing to a level above an upper wall of said housing.

31. The jack of claim 25, wherein said outer housing part has a front wall, a pair of substantially planar side walls, a substantially planar top wall extending beyond said side walls, and inner surfaces contiguous with said front wall, said outer housing part including an interposed rigid housing portion formed by said inner surfaces between each adjacent pair of said plug-receiving receptacles, each of said interposed portions including a bottom wall, an intermediate wall and a recessed aperture in said intermediate wall.

32. The jack of claim 25, further comprising cooperating securing means arranged on said inner housing part and said contact/terminal-retainer assemblies for securing said retainer housing of each of said contact/terminal-retainer assemblies to said inner housing part.

33. A communication card for use in a data utilization device, comprising:

a card member having a first and second end, a printed circuit board having electronic communications components mounted thereon, said components being situated between said printed circuit board and said card member, an electrical connector arranged at said first end of said card member for enabling electrical connection to the data utilization device, a jack connected to said second end of said card member and receivable of a mating plug, said jack comprising an outer housing part, and an inner housing assembly connected to said outer housing part and defining at least one plug-receiving receptacle with said outer housing part, said inner housing assembly including contact/terminal members, each of said contact/terminal members including a terminal portion electrically coupled to said printed circuit board, an arcuate contact portion situated in said plug-receiving receptacle and an intermediate bridging portion connecting said terminal portion to said contact portion, a portion of said bridging portion being inclined in relation to an inner surface of said outer housing part such that only a very short region of said bridging portion bears against an inner surface of said outer housing part.

34. The communication card of claim 33, wherein said outer housing part includes a top wall having an inner surface including recessed grooves, said short region of said bridging portion of each of said contact/terminal members being arranged in a respective one of said grooves.

35. The communication card of claim 33, wherein said contact portion is concave.

36. The communication card of claim 33, wherein said contact portion is convex.

37. The communication card of claim 33, wherein said inner housing assembly comprises an inner housing part and at least one discrete contact/terminal-retainer assembly, said contact/terminal members being arranged in each of said at least one contact/terminal-retainer assembly.

38. The communication card of claim 37, wherein each of said at least one contact/terminal-retainer assembly includes a housing, said bridging portion including an elongate section extending obliquely upward and outward from said housing to a level above an upper wall of said housing.

39. The jack of claim 16, wherein said receptacle opens at a front of said outer housing part, said contact portion of at least one of said contact/terminal members having a free end facing a rear of said outer housing part, said short region of said bridging portion being closer to said front of said outer housing part than said free end of said contact portion.

40. The jack of claim 26, wherein said receptacles open at a front of said outer housing part, said contact portion of at least one of said contact/terminal members having a free end facing a rear of said outer housing part, said short region of said bridging portion being closer to said front of said outer housing part than said free end of said contact portion.

41. The communication card of claim 33, wherein said receptacle opens at a front of said outer housing part, said contact portion of at least one of said contact/terminal members having a free end facing a rear of said outer housing part, said short region of said bridging portion being closer to said front of said outer housing part than said free end of said contact portion.

42. A modular electrical jack, comprising:

an outer housing part, and an inner housing assembly connected to said outer housing part and defining at least one plug-receiving receptacle with said outer housing part, said inner housing assembly comprising contact/terminal members, an inner housing part and at least one discrete contact/terminal-retainer assembly, at least one of said contact/terminal members being arranged in each of said at least one contact/terminal-retainer assembly, said at least one contact/terminal-retainer assembly including a retainer housing, at least one of said contact/terminal members including a terminal portion adapted to be connected to a substrate, an arcuate contact portion extending into a respective one of said at least one plug-receiving receptacle and an intermediate bridging portion connecting said terminal portion and said contact portion, a portion of said bridging portion being inclined in relation to an inner surface of said outer housing part such that only a very short region of said bridging portion bears against an inner surface of said outer housing part, said bridging portion including an elongate section extending obliquely upward and outward from said retainer housing terminating in a curved section, a portion of said curved section bearing against an inner surface of said outer housing part and remaining portions of said bridging portion being spaced from said inner surface.

43. A modular electrical jack, comprising:

an outer housing part, an inner housing assembly connected to said outer housing part and defining at least one plug-receiving receptacle with said outer housing part, said inner housing assembly comprising contact/terminal members, an inner housing part and at least one discrete contact/terminal-retainer assembly, at least one of said contact/terminal members being arranged in each of said at least one contact/terminal-retainer assembly, cooperating securing means arranged on said inner housing part and said at least one contact/terminal-retainer assembly for securing said retainer housing of each of said at least one contact/terminal-retainer assembly to said inner housing part, at least one of said contact/terminal members including a terminal portion adapted to be connected to a substrate, an arcuate contact portion extending into a respective one of said at least one plug-receiving receptacle and an intermediate bridging portion connecting said terminal portion and said contact portion, a portion of said bridging portion being inclined in relation to an inner surface of said outer housing part such that only a very short region of said bridging portion bears against an inner surface of said outer housing part.

* * * * *